US007701467B2

(12) United States Patent
Sakuta et al.

(10) Patent No.: US 7,701,467 B2
(45) Date of Patent: Apr. 20, 2010

(54) CHARACTER DISPLAY APPARATUS, CHARACTER DISPLAY METHOD, CHARACTER DISPLAY PROGRAM, AND RECORDING MEDIUM

(75) Inventors: Makoto Sakuta, Nara (JP); Noriyuki Koyama, Kyoto (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 220 days.

(21) Appl. No.: 10/563,325

(22) PCT Filed: Jul. 1, 2004

(86) PCT No.: PCT/JP2004/009344

§ 371 (c)(1),
(2), (4) Date: Jul. 6, 2006

(87) PCT Pub. No.: WO2005/004105

PCT Pub. Date: Jan. 13, 2005

(65) Prior Publication Data

US 2006/0250400 A1 Nov. 9, 2006

(30) Foreign Application Priority Data

Jul. 3, 2003 (JP) ..... 2003-191436

(51) Int. Cl.
*G09G 5/00* (2006.01)

(52) U.S. Cl. ..... 345/613; 345/467

(58) Field of Classification Search ..... 345/467–472.3, 345/611–616

See application file for complete search history.

(56) References Cited

U.S. PATENT DOCUMENTS 5,051,928 A * 9/1991 Gruters ..... 345/591

(Continued)

FOREIGN PATENT DOCUMENTS

EP 1 026 659 A2 8/2000

(Continued)

*Primary Examiner*—Kee M Tung
*Assistant Examiner*—David H Chu
(74) *Attorney, Agent, or Firm*—Birch, Stewart, Kolasch & Birch, LLP

(57) ABSTRACT

A character display apparatus of the present invention is a character display apparatus for displaying a character on a screen based on stroke data containing character information, comprising a control section for setting a color element level for a subpixel overlapping a basic portion of the character, based on both or either a distance between a center of the subpixel and at least one dot contained in a stroke or a line width set for the stroke. According to the present invention, the resolution of subpixels can be apparently improved and the line width of a character can be freely changed without a large amount of working memory.

23 Claims, 20 Drawing Sheets

U.S. PATENT DOCUMENTS

| | | | | |
|---|---|---|---|---|
| 5,170,442 | A * | 12/1992 | Murai et al. | 382/301 |
| 5,392,385 | A * | 2/1995 | Evangelisti et al. | 345/611 |
| 5,487,142 | A * | 1/1996 | Nakayama et al. | 345/443 |
| 5,731,839 | A * | 3/1998 | Panaro | 375/240.15 |
| 5,748,178 | A * | 5/1998 | Drewry | 345/643 |
| 6,570,562 | B1 * | 5/2003 | Myers | 345/418 |
| 6,791,569 | B1 * | 9/2004 | Millet et al. | 345/611 |
| 6,809,741 | B1 * | 10/2004 | Bates et al. | 345/597 |
| 2003/0095134 | A1 * | 5/2003 | Tuomi et al. | 345/611 |
| 2004/0064702 | A1 * | 4/2004 | Yu et al. | 713/176 |
| 2004/0075660 | A1 * | 4/2004 | Liao et al. | 345/441 |
| 2004/0189662 | A1 * | 9/2004 | Frisken et al. | 345/611 |
| 2005/0219261 | A1 * | 10/2005 | Asai et al. | 345/613 |
| 2005/0226538 | A1 * | 10/2005 | Di Federico et al. | 382/299 |

FOREIGN PATENT DOCUMENTS

| | | | |
|---|---|---|---|
| EP | 1 111 579 | A2 | 6/2001 |
| EP | 1 225 560 | A2 | 7/2002 |
| EP | 1 271 466 | A2 | 1/2003 |
| JP | 62-24297 | A | 2/1987 |
| JP | 6-4679 | A | 1/1994 |
| JP | 8-138067 | A | 5/1996 |
| JP | 09-244616 | | 9/1997 |
| JP | 314612 | | 9/1997 |
| JP | 09-269764 | | 10/1997 |
| JP | 415374 | | 12/2000 |
| JP | 2001-100725 | A | 4/2001 |
| JP | 2002-40980 | A | 2/2002 |
| WO | WO-03/085636 | A1 | 10/2003 |

* cited by examiner

FIG.6

| Thickness | Y direction stroke-subpixel distance range | | | | |
|---|---|---|---|---|---|
| | 0~0.3 | 0.3~0.8 | 0.8~1.2 | 1.2~1.6 | 1.6~2.0 |
| Thick | 7 | 5 | 4 | 2 | 1 |
| Intermediate | 7 | 4 | 2 | 1 | |
| Thin | 7 | 2 | 1 | | |

72b

FIG.8

(a)

| First color element level | Distance from subpixel having a set first color element level | | | | |
|---|---|---|---|---|---|
| | 0 | 1 | 2 | 3 | 4 |
| 7 | 7 | 5 | 4 | 3 | 2 |
| 5 | 5 | 4 | 3 | 1 | |
| 4 | 4 | 2 | | | |
| 2 | 2 | | | | |
| 1 | 1 | | | | |

← 73b (b)

| First color element level | Distance from subpixel having a set first color element level | | | | |
|---|---|---|---|---|---|
| | 0 | 1 | 2 | 3 | 4 |
| 7 | 7 | 4 | 3 | 2 | |
| 5 | 5 | 3 | 1 | | |
| 4 | 4 | 1 | | | |
| 2 | 2 | | | | |
| 1 | 1 | | | | |

← 73b (c)

| First color element level | Distance from subpixel having a set first color element level | | | | |
|---|---|---|---|---|---|
| | 0 | 1 | 2 | 3 | 4 |
| 7 | 7 | 3 | 1 | | |
| 5 | 5 | 2 | | | |
| 4 | 4 | | | | |
| 2 | 2 | | | | |
| 1 | 1 | | | | |

← 73b (a)

(b)

(c)

CHARACTER DISPLAY APPARATUS, CHARACTER DISPLAY METHOD, CHARACTER DISPLAY PROGRAM, AND RECORDING MEDIUM

TECHNICAL FIELD

The present invention relates to a character display apparatus and a character display method for displaying characters using a display device capable of color display, a character display program for causing a computer to perform the method, and a computer readable recording medium which stores the program.

BACKGROUND ART

A conventional character display apparatus for displaying characters with high definition using a display device capable of color display, is disclosed in, for example, Japanese Laid-Open Publication No. 2001-100725.

In the character display apparatus of Japanese Laid-Open Publication No. 2001-100725, the color element levels of subpixels corresponding to a basic portion of a character are set to a predetermined color element level. The color element levels of subpixels adjacent to the subpixels corresponding to the basic portion of the character are set to color element levels other than the predetermined color element level, based on at least one correction pattern. The set color element levels are converted to brightness levels based on a predetermined table. As a result, the character is displayed on a display section (display device).

In this conventional technology, the basic portion of a character refers to a core (central backbone) of the character.

Data, such as RGB, CYM, or the like, are assigned as color elements to individual subpixels contained in pixels. A color element level indicates how much a color element contributes to a character color. In this conventional technology, a color element level is represented by a value of "0" to "7". "7" indicates a character color. "0" indicates a background color. Thus, by using color element levels assigned on a subpixel-by-subpixel basis, it is possible to construct a logical model which does not rely on a combination of actual character and background colors.

In order to actually display characters on the character display apparatus, color element levels need to be converted to brightness values. To achieve this, a brightness table for use in converting color element levels to brightness values is provided, depending on a combination of a character color and a background color. For example, when a black character is displayed in a white background, the color element level "7" is converted to a set of brightness values for R, G and B, which are all "0" while the color element level "0" is converted to a set of brightness values for R, G and B, which are all "255".

FIG. 16 is a diagram showing an example, in which the color element levels of subpixels corresponding to the basic portion of a character "/" are set to a predetermined value, and the color element levels of subpixels adjacent to the basic portion of the character are set based on a certain correction pattern.

Each rectangle corresponds to a single subpixel. A hatched rectangle is a subpixel, the color element level of which is represented by the concentration thereof. The color element level is increased with an increase in the concentration. In this example, there are four color element levels, i.e., "0", "1", "2" and "3". When a luminous level ranges from "0" to "255", the color element levels are converted to respective luminous levels "255", "170", "85" and "0", which are displayed on a display section.

Thus, by controlling the color element levels of subpixels separately, a resolution can be apparently improved in a direction along which the subpixels are arranged. Further, by appropriately controlling the color element levels of subpixels adjacent to subpixels corresponding to the basic portion of a character, colors other than black imparted to a character cannot be easily recognized by human eyes. As a result, the contour of a character as well as the character itself can be displayed with high definition on a display screen.

Another conventional technology for displaying a character by controlling subpixels separately is disclosed in Japanese Laid-Open Publication No. 2002-91369.

In a conventional display apparatus disclosed in Japanese Laid-Open Publication No. 2002-91369, for the size of a character to be displayed, a rasterized character image has a 3-fold size in a longitudinal direction of a subpixel and a 3-fold size in an arrangement direction of subpixels. A subpixel is associated with each picture element array of three picture elements (pixels) successively arranged in the longitudinal direction of a subpixel contained in the character image. The brightness value of a subpixel is calculated based on the picture element values of its associated picture elements successively arranged in the longitudinal direction.

FIG. 17 is a diagram for explaining a specific operation of the conventional display apparatus of Japanese Laid-Open Publication No. 2002-91369.

Generally, an image, such as character or graphics, is represented by binary picture element values. As shown in FIG. 17(*a*), for example, when a slant line is displayed on a display screen, one of two brightness values is simply mapped to each picture element (pixel). In FIGS. 17(*a*) and 17(*b*), each rectangle represents a pixel constituting a display screen, and a filled portion corresponds to a slant line.

In this case, in the conventional display apparatus disclosed in Japanese Laid-Open Publication No. 2002-91369, simple mapping to each picture element on a display screen is not performed. Initially, a character image having a resolution three times that of the display apparatus is produced. For example, when it is assumed that one picture element of the display apparatus is composed of a 3×3 matrix, a rasterized character image has a size three times larger than an image to be displayed. For example, when a slant line as shown in FIG. 17(*a*) is rasterized with a resolution three times that of the display apparatus, a rasterized image as shown in FIG. 17(*b*) is obtained.

An average value of a plurality of picture elements contained in the above-described character image having the 3-fold size, which are associated with each subpixel of the display apparatus, is mapped to the picture element. For example, the character image of FIG. 17(*b*) is mapped to subpixels shown in FIG. 17(*c*). In FIG. 17(*c*), a rectangle corresponds to a subpixel. A subpixel with a character R thereabove exhibits a red color. A subpixel with a character G thereabove exhibits a green color. A subpixel with a character B thereabove exhibits a blue color. In addition, a filled portion indicates six subpixels to which an average value of picture element values is mapped. Each of the six subpixels, which are longer than are wide, corresponds to three adjacent picture elements in the vertical direction of FIG. 17(*b*).

As a result, the resolution of the arrangement direction of subpixels can be improved. In addition, since the intensity of color exhibited by each subpixel is determined depending on how much a portion of a character generated with a 3-fold resolution is associated with a single subpixel, the resolution in the longitudinal direction of the subpixel can be apparently improved.

However, in the above-described conventional technology of Japanese Laid-Open Publication No. 2001-100725, the resolution in the longitudinal direction of subpixels is not taken into consideration. Therefore, when a slant line is displayed, jaggies are significant depending on the degree of the slant angle.

In the above-described conventional technology of Japanese Laid-Open Publication No. 2002-91369, a rasterized character image has a 3-fold resolution in the process. Therefore, a problem arises that a large amount of working memory is required. Moreover, there is a limitation such that the width or font of characters cannot be freely changed.

The present invention provides a solution to the above-described conventional problems. An object of the present invention is to provide a character display apparatus and a character display method, which apparently improve resolutions of subpixels in an arrangement direction and a longitudinal direction without a large amount of working memory and are capable of freely changing the width of a character; and a character display program for causing a computer to perform the steps of the method; and a computer readable recording medium.

DISCLOSURE OF THE INVENTION

The present invention provides a character display apparatus for displaying a character on a screen based on stroke data containing character information, comprising a control section for setting a color element level for a subpixel overlapping a basic portion of the character, based on both or either a distance between a center of the subpixel and at least one dot contained in a stroke or a line width set for the stroke. Thereby, the above-described object is achieved.

The at least one dot contained in the stroke may have the same X-coordinate value as the center of the subpixel.

The control section may set a smaller color element level of the subpixel as the distance is increased.

The control section may set the color element level of the subpixel based on a line width in at least one of an X direction and a Y direction set for the stroke.

The control section may set the color element level of the subpixel to a predetermined value when the distance is within a predetermined range.

The character display apparatus may comprise a display section comprising a plurality of display pixels arranged in a matrix on the screen, each of the plurality of display pixels comprising a plurality of the subpixels arranged in a predetermined direction and associated with a plurality of respective color elements. The control section may control display of the character on the screen by controlling levels of the plurality of color elements associated with the plurality of subpixels based on the stroke data separately.

The character display apparatus may comprise a storage section storing a table associating at least one of the distance between the center of the subpixel and the at least one dot contained in the stroke and the line width set for the stroke with the color element level of the subpixel. The control section may set the color element level of the subpixel based on information of the table.

The control section may set a color element level for a subpixel near the subpixel having the set color element level, based on a distance between the subpixels and the set color element level.

The character display apparatus may comprise a storage section storing a table associating the distance between the subpixel having the set color element level and the near subpixel, and the set color element level with the color element level of the near subpixel. The control section may set the color element level of the near subpixel based on information in the table.

The stroke data may be skeleton data representing a skeletal shape of the character or character contour information representing a contour shape of the character.

The present invention provides a character display apparatus for displaying a character based on stroke data containing character information, comprising a control section for setting a color element level for a subpixel within a predetermined range based on both or either a distance between a center of the subpixel and at least one dot contained in a stroke or a line width set for the stroke. Thereby, the above-described object is achieved.

The control section may set the color element level of the subpixel within the predetermined range based on a predetermined table defining the color element level of the subpixel within the predetermined range and the distance.

The at least one dot contained in the stroke may have the same X-coordinate value as the center of the subpixel.

The control section may set a smaller color element level for the subpixel as the distance is increased.

The control section may set the color element level of the subpixel based on a line width in at least one of an X direction and a Y direction set for the stroke.

The control section may set the color element level of the subpixel to a predetermined value when the distance is within a predetermined range.

The character display apparatus may comprise a display section comprising a plurality of display pixels arranged in a matrix on the screen, each of the plurality of display pixels comprising a plurality of the subpixels arranged in a predetermined direction and associated with a plurality of respective color elements. The control section may control display of the character on the screen by controlling levels of the plurality of color elements associated with the plurality of subpixels based on the stroke data separately.

The character display apparatus may comprise a storage section storing a table associating at least one of the distance between the center of the subpixel and the at least one dot contained in the stroke and the line width set for the stroke with the color element level of the subpixel. The control section may set the color element level of the subpixel based on information of the table.

The control section may set a color element level for a subpixel near the subpixel having the set color element level based on a distance between the subpixels and the set color element level.

The character display apparatus may comprise a storage section storing a table associating the distance between the subpixel having the set color element level and the near subpixel and the set color element level with the color element level of the near subpixel. The control section may set the color element level of the near subpixel based on information of the table.

The stroke data may be skeleton data representing a skeletal shape of the character or character contour information representing a contour shape of the character.

The present invention provides a character display method for displaying a character based on stroke data containing character information, comprising both or either the step of obtaining a distance between a center of a subpixel overlapping a basic portion of the character and at least one dot contained in a stroke or the step of obtaining a line width set for the stroke, and the step of setting a color element level for the subpixel based on both or either the obtained distance or the line width. Thereby, the above-described object is achieved.

The present invention provides a character display program for causing a computer to execute the steps of the above-described character display method.

The present invention provides a computer readable recording medium recording the above-described character display program.

The present invention provides a character display method for displaying a character on a screen based on stroke data containing character information, comprising both or either the step of obtaining a distance between a center of a subpixel within a predetermined range and at least one dot contained in a stroke or the step of obtaining a line width set for the stroke, and the step of setting a color element level for the subpixel based on both or either the obtained distance or the line width. Thereby, the above-described object is achieved.

The present invention provides a character display program for causing a computer to execute the steps of the above-described character display method.

The present invention provides a computer readable recording medium recording the above-described character display program.

EFFECT OF THE INVENTION

Effects and functions of the present invention will be described.

In the character display apparatus of the present invention, the color element level of a subpixel overlapping the basic portion of a character is controlled to be set based on at least one of a distance between the center of the subpixel and at least one dot contained in a stroke or a line width set for the stroke. Thereby, the color element level of each subpixel can be controlled to be set based on stroke data quickly and with high definition without a large amount of working memory. The stroke data can be skeleton data representing the skeletal shape of the character, character contour information representing the contour shape of the character, or the like.

In the character display apparatus of the present invention, a color element level for a subpixel within a predetermined range is controlled to be set based on at least one of a distance between the center of the subpixel and at least one dot contained in a stroke or a line width set for the stroke. Thereby, the color element level of each subpixel can be controlled to be set based on stroke data quickly and with high definition without a large amount of working memory. The line width or font of a character can be flexibly changed. The predetermined range defines a range of subpixels to be handled, and may be, for example, a predetermined subpixel region near the basic portion of a character. Alternatively, the predetermined range may be determined based on a distance between a subpixel overlapping a stroke and other subpixels.

A table associating at least one of a distance between the center of a subpixel and at least one dot contained in a stroke and a line width set for the stroke with the color element level of the subpixel, is previously provided. The color element level of a subpixel can be controlled to be set based on the information of the table. Thereby, the color element level can be controlled to be set quickly and meticulously.

At least one dot contained in a stroke can have the same X-coordinate value as the center of a subpixel. Thereby, the color element level of a subpixel can be controlled based on positional relationship in the Y direction. Therefore, the resolution in the longitudinal direction of subpixels can be apparently improved.

The color element level of a subpixel is controlled to be set to a smaller value as the distance between the center of the subpixel and at least one dot contained in a stroke is increased. Thereby, a character can be smoothly displayed.

The color element level of a subpixel can be controlled to be set based on a line width in at least one of the X direction and the Y direction set for a stroke. Thereby, the line width of a character can be minutely set.

When a distance between the center of a subpixel and at least one dot contained in a stroke is within a predetermined range (e.g., less than 0.3), the color element level of the subpixel can be controlled to be set to a predetermined value (e.g., a maximum value "7"). Thereby, the core portion of a stroke can be emphasized.

The color element level of a subpixel can be set in two steps or more, though it can be set in one step. For example, when it is set in two steps, a color element level for a subpixel (first color element level) is set based on at least one of a distance between the center of the subpixel and at least one dot contained in a stroke and a line width set for the stroke. Color element levels (second color element levels) for the subpixel and a subpixel near thereto can be set based on a distance between the near subpixel and the subpixel having the first color element level, and the first color element level.

In this case, a table associating the distance between the near subpixel and the subpixel having the first color element level and the first color element level with the second color element level, may be previously provided. Based on the information of the table, the second color element level can be controlled to beset. Thereby, the color element level can be controlled to be set quickly and meticulously.

The character display method of the present invention comprises the steps of obtaining at least one of a distance between a center of a subpixel overlapping a basic portion of a character and at least one dot contained in a stroke and a line width set for the stroke, and setting a color element level for the subpixel based on at least one of the obtained distance and line width. Thereby, the color element level of each subpixel can be controlled to be set based on stroke data quickly and with high definition without a large amount of working memory.

The character display method of the present invention comprises the steps of obtaining at least one of a distance between a center of a subpixel within a predetermined range and at least one dot contained in a stroke and a line width set for the stroke, and setting a color element level for the subpixel based on at least one of the obtained distance and line width. Thereby, the color element level of each subpixel can be controlled to be set based on stroke data quickly and with high definition without a large amount of working memory. The line width or font of a character can be flexibly changed.

The character display program of the present invention describes a procedure for causing a computer to execute the character display method of the present invention. Thereby, the color element level of each subpixel can be controlled using a computer to be set based on stroke data quickly and with high definition without a large amount of working memory. Further, the line width or font of a character can be flexibly changed.

The readable recording medium of the present invention is a computer readable recording medium recording the character display program of the present invention. Thereby, the color element level of each subpixel can be controlled using a computer to be set based on stroke data quickly and with high definition without a large amount of working memory. Further, the line width or font of a character can be flexibly changed.

BRIEF DESCRIPTION OF THE DRAWINGS

FIG. 6 is a diagram showing an exemplary set of specific numerical figures of a Y direction correction table of FIG. 1.

FIGS. 8(*a*) to 8(*c*) are diagrams showing exemplary numerical figures on an X direction correction table of FIG. 1.

FIG. 9(*a*) is a diagram showing first color element levels set for two exemplary subpixels. FIG. 9(*b*) is a diagram showing second color element levels set based on a subpixel 26A of FIG. 9(*a*). FIG. 9(*c*) is a diagram showing second color element levels set based on a subpixel 26B of FIG. 9(*a*).

FIG. 17(*a*) shows a state of a slant line rasterized in pixels. FIG. 17(*b*) shows a state of the slant line of FIG. 17(*a*) which is rasterized with 3-fold resolution. FIG. 17(*c*) is a diagram showing a state of the slant line of FIG. 17(*b*) which is mapped to subpixels.

BEST MODE FOR CARRYING OUT THE INVENTION

Hereinafter, embodiments of the present invention will be described with reference to the accompanying drawings.

Embodiment 1

Figure 1:
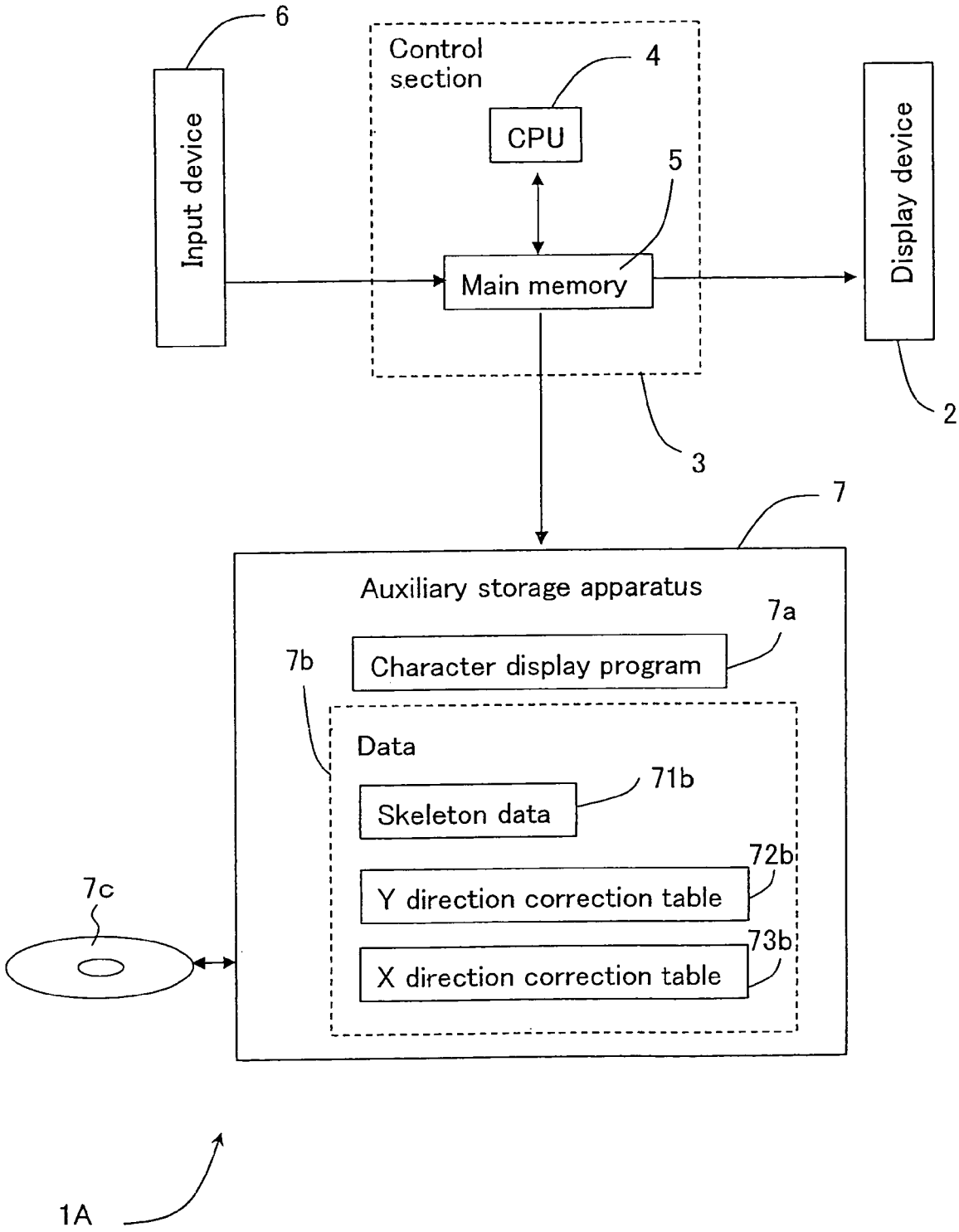
FIG. 1 is a block diagram showing a major configuration of a character display apparatus according to Embodiment 1 of the present invention.

FIG. 1 is a block diagram showing a major configuration of a character display apparatus according to Embodiment 1 of the present invention.

In FIG. 1, a character display apparatus 1A may be, for example, implemented by a personal computer. As a personal computer, a computer of any type, such as desktop, laptop, or the like, can be used. Alternatively, the character display apparatus 1A may be implemented by a word processor.

Alternatively, the character display apparatus 1A may be any apparatus, such as an electronic instrument, an information instrument, or the like, which comprises a display device capable of color display. For example, the character display apparatus 1A may be an electronic instrument (e.g., a digital camera comprising a color liquid crystal display device, etc.), a personal digital assistant which is a portable information tool, a mobile telephone (e.g., PHS), a communication instrument (e.g., general telephone/FAX, etc.), or the like.

The character display apparatus 1A has a display device 2 as a display section capable of color display, a control section 3 which is connected to the display device 2 and controls a plurality of color elements corresponding to a plurality of subpixels contained in a display screen of the display device 2 separately, an input device 6 connected to the control section 3, and an auxiliary storage apparatus 7 as a storage section connected to the control section 3.

As the display device 2, any color display apparatus having a plurality of pixels (picture elements) arranged in a matrix on a display screen can be used, including, for example, a color liquid crystal display device.

Figure 2:
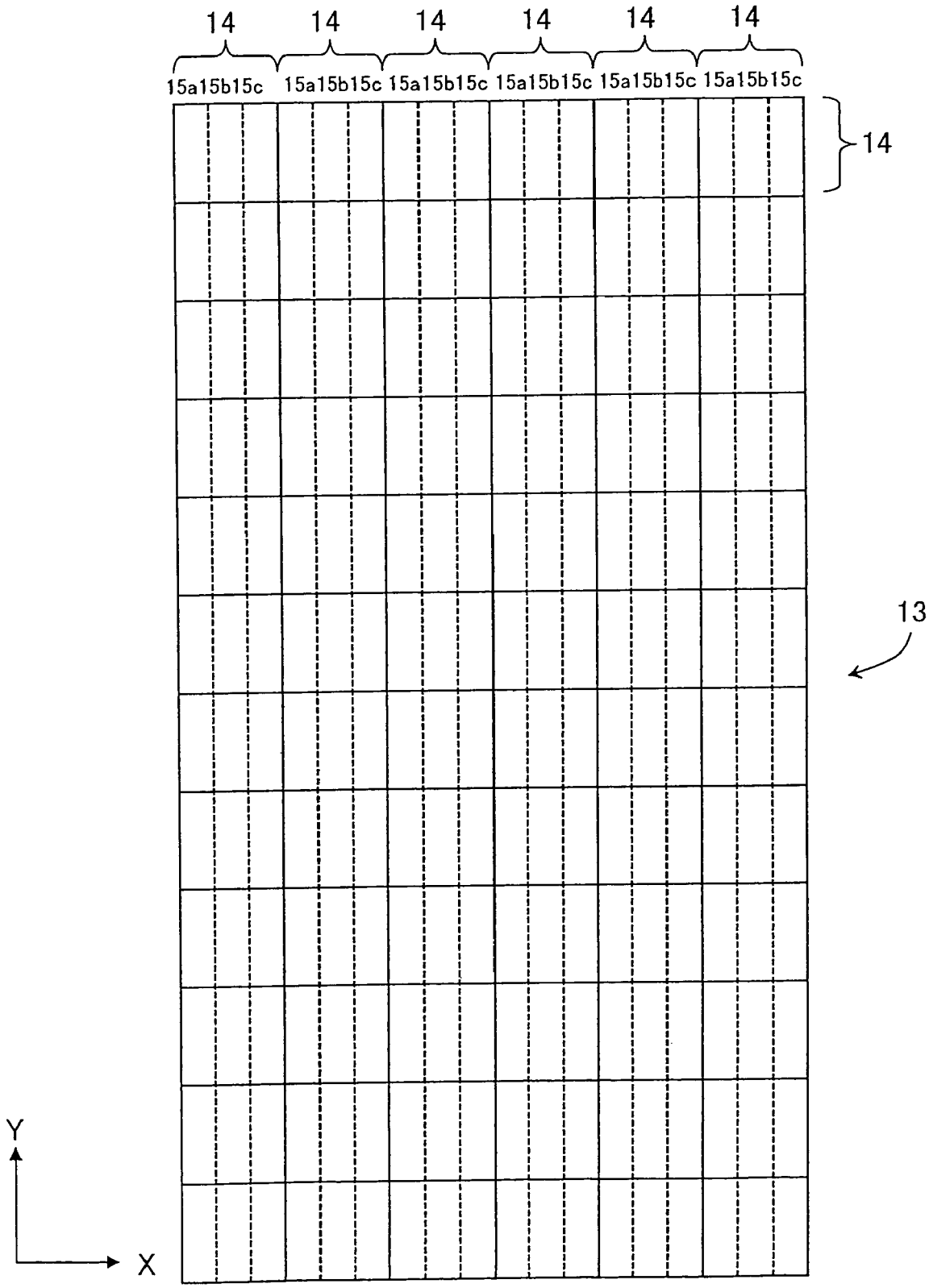
FIG. 2 is a diagram schematically showing a structure of a display screen of a display device of FIG. 1.

FIG. 2 is a diagram schematically showing a display screen 13 of the display device 2 of FIG. 1.

The display device 2 has a plurality of pixels 14 which are arranged in a matrix along an X direction and a Y direction indicated by arrows in a lower left portion of FIG. 2. Each of the plurality of pixels 14 comprises a plurality of subpixels arranged in the X direction. In the example of FIG. 2, one pixel 14 has three subpixels 15*a*, 15*b* and 15*c*, which are laterally adjacent to one another. The subpixel 15*a* is previously assigned to a color element R in order to exhibit R (red). The subpixel 15*b* is previously assigned to a color element G in order to exhibit G (green). The subpixel 15*c* is previously assigned to a color element B in order to exhibit B (blue). The X direction indicates a direction along which a plurality of subpixels constituting a pixel are adjacent to one another, while the Y direction indicates a direction perpendicular to the X direction.

Note that the number of subpixels contained in each pixel is not limited to "3". Each pixel may contain two or more subpixels arranged in a predetermined direction. For example, when colors are displayed by N color elements ($N \geqq 2$: natural number), each pixel contains N subpixels. The arrangement order of color elements is not limited to that shown in FIG. 2. For example, color elements may be arranged in order of B, G and R in the X direction. Moreover, the arrangement direction of subpixels is not limited to the direction shown in FIG. 2. Subpixels may be arranged in any directions.

Color elements corresponding to subpixels are not limited to R (red), G (green) and B (blue), and may be other color elements, such as C (cyan), Y (yellow) and M (magenta), and the like.

The control section 3 has a CPU 4 (central processing unit) and a main memory 5. The control section 3 controls the display of the display device 2 by controlling the setting of color element levels of subpixels contained in the display screen of the display device 2, based on a character display program 7*a* and various data 7*b* so that a character is displayed on the display screen 13.

More specifically, the control section 3 controls a plurality of color element levels assigned to respective subpixels 15*a* to 15*c* arranged on the display screen 13 of the display device 2 separately, so that information representing a character input via the input device 6 is displayed on the display device 2.

The CPU 4 contained in the control section 3 controls and monitors the whole character display apparatus 1A, and executes each step of the character display program 7*a* stored in the auxiliary storage apparatus 7.

The main memory 5 contained in the control section 3 temporarily stores the character display program 7*a* as well as the various data 7*b*, such as data input via the input device 6, data to be displayed on the display device 2, data required to execute the character display program 7*a*, and the like. The main memory 5 is accessed by the CPU 4.

Each step of the character display program 7*a* is executed based on the display program 7*a* and the various data 7*b* read into the main memory 5 by the CPU 4, resulting in a character pattern. The resultant character pattern is temporarily stored in the main memory 5 and is then output and displayed on the display device 2. The timing of outputting and displaying the character pattern on the display device 2 is controlled by the CPU 4.

The input device 6 is used to input character information, which is to be displayed on the display device 2, into the control section 3. Examples of character information include character codes for identifying characters, character sizes indicating the sizes of characters, line widths in the X direction and the Y direction of strokes of a character to be displayed, and the like.

As the input device 6, an input device of any type which can input a character code, a character size, and the line widths in the X direction and the Y direction of a stroke, can be used. For example, an input device, such as a keyboard, a mouse, a pen input apparatus or the like, is preferably used as the input device 6.

In Embodiment 1, the line widths in the X direction and the Y direction of a stroke of a display character input via the input device 6 are designated in three levels: "thick" indicating a thick character; "intermediate" indicating an intermediate line width; and "fine" representing a fine line width. Note that a line width set for a stroke may be set via the input device 6 by the user, or alternatively, a preset line width or a line width reset due to a subsequent change in specification may be used.

The auxiliary storage apparatus 7 stores the character display program 7*a* and the various data 7*b* required to execute the character display program 7*a*. The required various data 7*b* contains skeleton data 71*b* which defines a skeletal shape of a character, and a Y direction correction table 72*b* and an X direction correction table 73*b* which are described below, and the like.

Although a stroke is defined as a line segment having no thickness, which constitutes a skeletal shape of a character in Embodiment 1, a stroke may be defined as a line segment having a thickness, which constitutes a contour shape of a character as described in Embodiment 2. Skeleton data is used for specifying the skeletal shape of each stroke constituting a character. Alternatively, as described in Embodiment 2 below, stroke data may define a contour shape of each stroke constituting a character. Therefore, the term skeleton data is used to distinguish it from such stroke data.

The auxiliary storage apparatus 7 may be a storage apparatus of any type which can store the character display program 7*a* and the data 7*b*. In the auxiliary storage apparatus 7, any recording medium can be used as a recording medium 7*c* which stores the character display program 7*a* and the various data 7*b* required for it. As the recording medium 7*c*, for example, various computer readable recording media, such as a hard disk, a CD-ROM, an MO, a flexible disk, a MD, a DVD, an IC card, an optical card and the like, can be preferably used.

Although the character display program 7*a* and the data 7*b* are stored in a recording medium of the auxiliary storage apparatus 7, the present invention is not limited to this. For example, the character display program 7*a* and the data 7*b* may be stored in the main memory 5 or a ROM (not shown). As such a ROM, for example, a mask ROM, an EPROM, an EEPROM, a flash ROM or the like can be used. In the case of the ROM system, various processes can be easily implemented by exchanging ROMs. For example, the ROM system can be preferably applied to a mobile terminal apparatus, a mobile telephone and the like.

Moreover, a recording medium for storing the character display program 7*a* and the data 7*b* may include a medium which fixedly carries a program or data (e.g., a medium, such as the above-described disk or card or the like, a semiconductor memory, etc.).

Next, each item of the data 7*b* stored in the auxiliary storage apparatus 7 will be described. The data 7*b* contains the skeleton data 71*b* which defines the skeletal shape of a character, and the Y direction correction table 72*b* and the X direction correction table 73*b*.

Firstly, the skeleton data 71*b* will be described.

Figure 3:
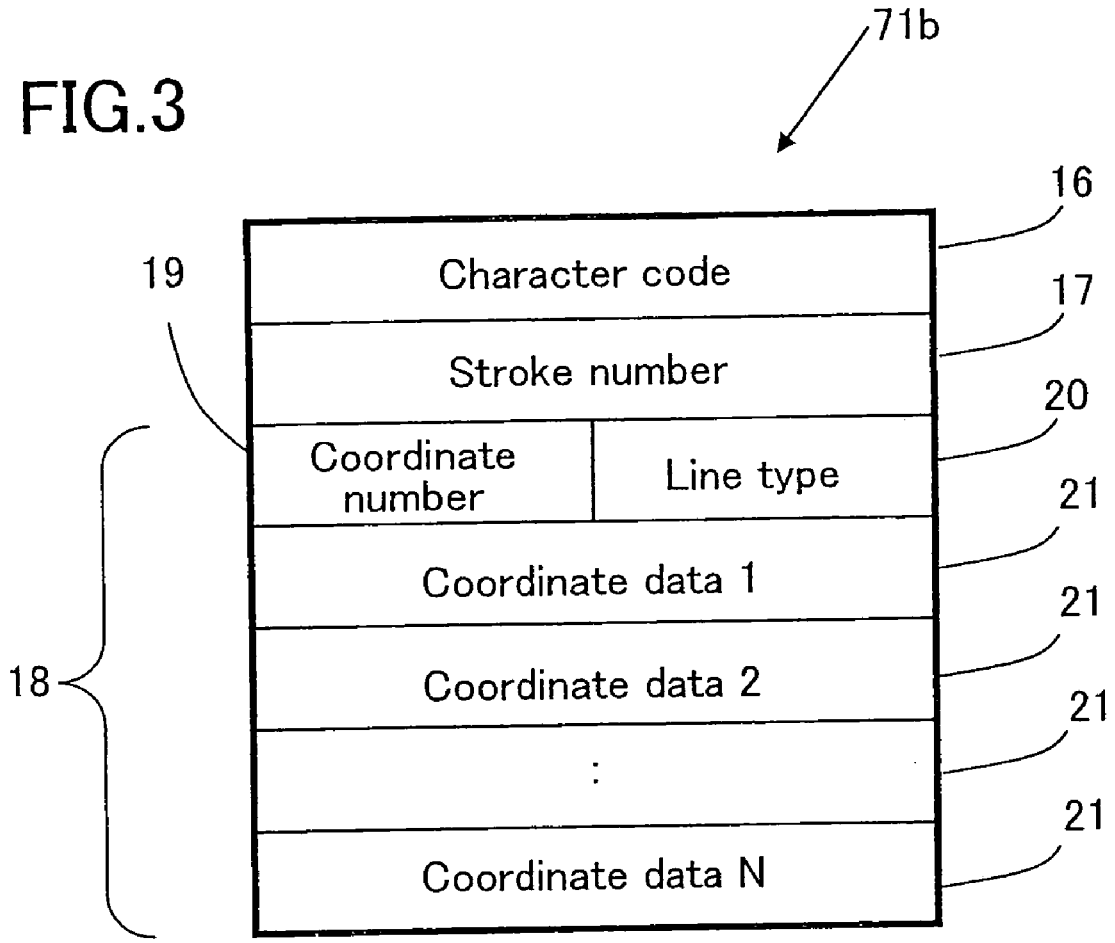
FIG. 3 is a diagram showing an exemplary data structure of skeleton data of FIG. 1.

FIG. 3 is a diagram showing an exemplary data structure of the skeleton data 71*b* stored in the auxiliary storage apparatus 7 of FIG. 1.

In FIG. 3, the skeleton data 71*b* indicates the skeletal shape of a character, including a character code 16 for distinguishing character types from one another, a stroke number 17 indicating the number M of strokes constituting a character (M is an integer of 1 or more), and stroke information 18 corresponding to each stroke.

The stroke information 18 contains a coordinate number 19 indicating the number N of dots constituting a stroke (N is an integer of 1 or more), a line type 20 indicating the line type of the stroke, and a plurality of sets of coordinate data 21 indicating the coordinates of the dots constituting the stroke.

The number of the coordinate data sets 21 (the number of dots) is equal to the coordinate number 19. Thus, N sets of coordinate data are stored as coordinates constituting a stroke. Also, the number of sets of the stroke information 18 is equal to the stroke number 17. Thus, the skeleton data 71*b* contains M sets of stroke information 18.

The line type 20 includes, for example, a line type "straight line" and a line type "curve". When the line type 20 is the "straight line", a plurality of dots constituting a stroke is approximated by a straight line. When the line type 20 is the "curve", dots constituting a stroke are approximated by a curve (e.g., a spline curve, etc.).

Figure 4:
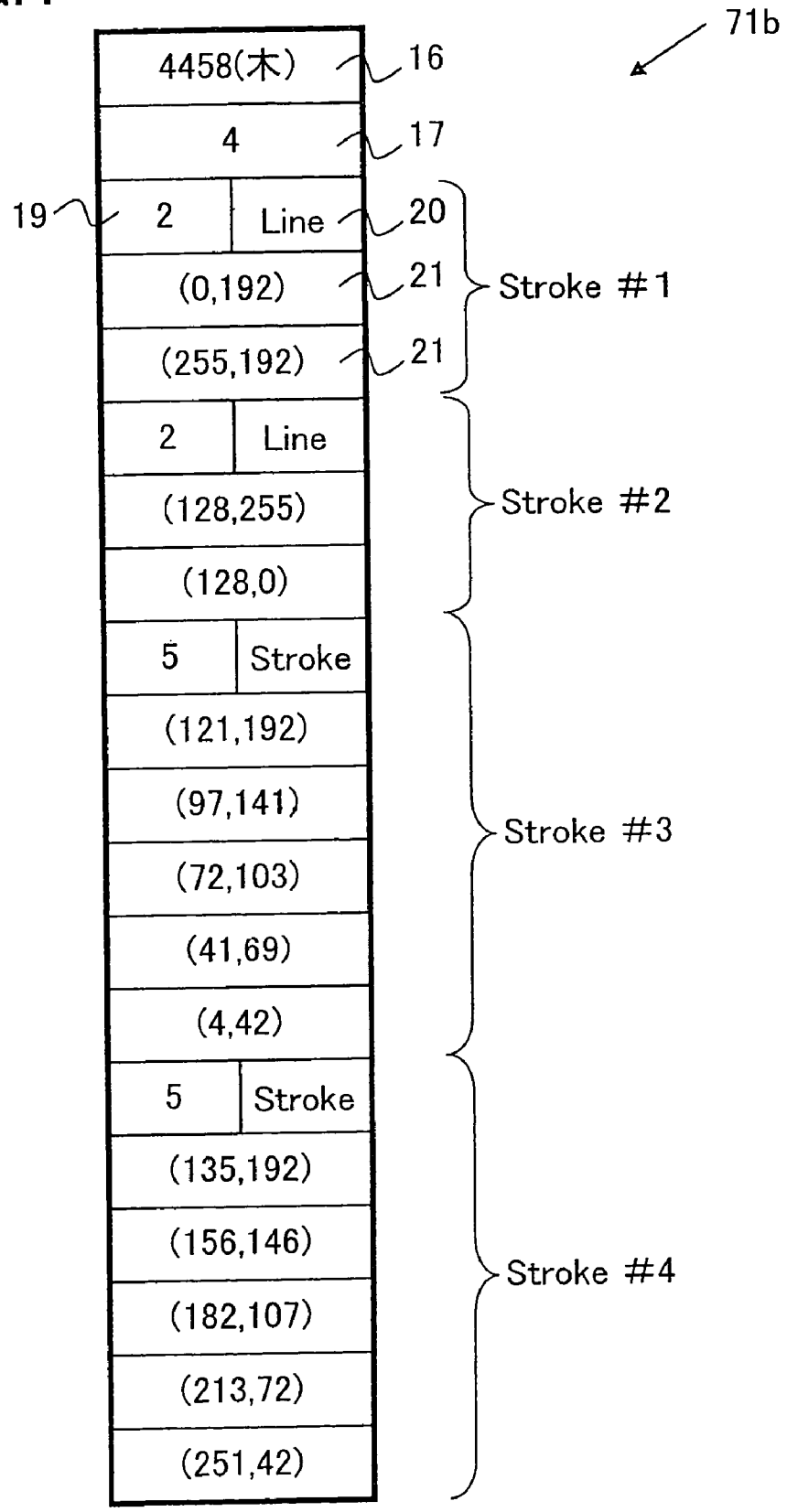
FIG. 4 is a diagram showing an example in which skeleton data of "木" is applied to FIG. 1.

FIG. 4 is a diagram showing an example of the skeleton data 71*b* indicating a skeletal shape of a Kanji character "木".

In FIG. 4, the skeleton data 71*b* indicating the skeletal shape of the Kanji character "木" has four strokes #1 to #4.

The stroke #1 is defined as a straight line connecting between a start dot (0, 192) and an end dot (255, 192). The stroke #2 is defined as a straight line connecting a start dot (128, 255) and an end dot (128, 0). The stroke #3 is obtained by approximating five dots (121, 192), (97, 141), (72, 103), (41, 69) and (4, 42) by a curve. The stroke #4 is obtained by approximating five dots (135, 192), (156, 146), (182, 107), (213, 72) and (251, 42) by a curve.

Figure 5:
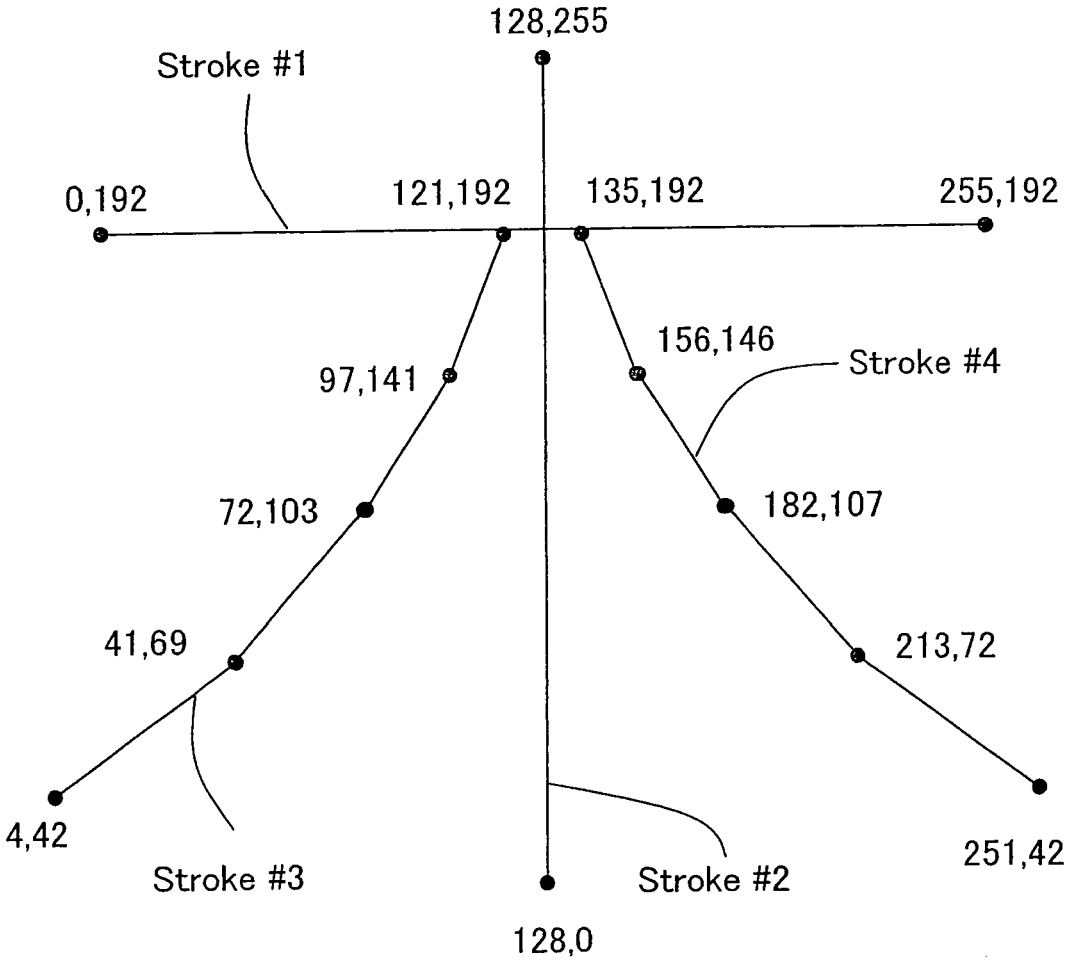
FIG. 5 is a diagram showing an example of the skeleton data "木" of FIG. 4, which are displayed on a coordinate plane.

FIG. 5 is a diagram showing an example of the skeleton data 71*b* indicating the skeletal shape of the Kanji character "木" of FIG. 4, which is displayed on a coordinate plane. In the example of FIG. 5, for the sake of simplicity, the strokes #3 and #4 are approximated by straight lines.

Next, the Y direction correction table 72*b* will be described.

The Y direction correction table 72*b*, stored in the auxiliary storage apparatus 7, is used by the control section 3 to set first color element levels for subpixels in the basic portion of a character to be displayed, and subpixels successively arranged in the Y direction from the basic portion of the character. As described below, the Y direction correction table 72*b* associates the value of the first color element level with a combination of a range including a Y-direction distance between a stroke (a dot in the stroke) and a subpixel and the Y-direction line width of a stroke input via the input device 6.

In Embodiment 1, the color element level of each subpixel is not directly determined and is determined in two steps.

Initially, a color element level is determined for a subpixel of interest based on a Y-direction distance between a stroke and a center of the subpixel and the Y-direction line width of the stroke. In Embodiment 1 and Embodiment 2, this color element level is referred to as a first color element level.

Next, a color element level is determined for a subpixel-adjacent in the X direction to the subpixel having the first color element level, based on a distance between the first color element level subpixel and the adjacent subpixel and the X-direction line width of a stroke. In Embodiment 1 and Embodiment 2, this color element level is referred to as a second color element level. This second color element level is used as a color element level which is eventually converted to a brightness value of the display device 2.

The reason why a color element level is determined in two steps is that a table used is simplified. A color element level may be determined in one step or in three steps or more.

FIG. 6 is a diagram showing an exemplary set of specific numerical figures of the Y direction correction table 72*b* stored in the auxiliary storage apparatus 7 of FIG. 1.

In FIG. 6, the Y direction correction table 72*b* contains ranges of a Y-direction distance between a stroke and a subpixel, i.e., 0 to 0.3, 0.3 to 0.8, 0.8 to 1.2, 1.2 to 1.6 and 1.6 to 2.0, where a to b represents a range between a (inclusive) and b (non-inclusive), and Y-direction line widths (thickness) of a stroke, i.e., "thick", "intermediate" and "thin". Combinations of these items are associated with values of the first color element level.

The control section 3 uses the Y direction correction table 72*b* to set a first color element level for a subpixel within a predetermined range in the Y direction. The range includes a subpixel(s) overlapping the basic portion of a character.

In Embodiment 1, when the skeleton data 71*b* is mapped onto the display screen 13 based on a character size, a subpixel(s) through which a stroke is passed is regarded as a basic portion of a character.

The control section 3 determines the first color element level of the basic portion of a character as follows.

A center of a subpixel overlapping the basic portion of a character, and a distance between the X-coordinate value of the center and a dot on a stroke having the same X coordinate value as that of the center (hereinafter referred to as a Y direction stroke-subpixel distance), are calculated. A stroke-subpixel distance range defined in the Y direction correction table 72*b* including the calculated distance, and a Y-direction line width of the stroke input via the input device 6, determine actable value in the Y direction correction table 72*b* as a first color element level. A subpixel which does not overlap the basic portion may also be set to have the first color element level, if the subpixel has the same X-coordinate value as that of a dot on a stroke.

Similarly, the control section 3 sets a first color element level for a subpixel(s) successively arranged in the Y direction from the basic portion of a character (a subpixel(s) having the same X-coordinate value as that of a subpixel overlapping the basic portion of the character) as follows.

The Y direction stroke-subpixel distance of a subpixel(s) successively arranged in the Y direction from the basic portion of a character is calculated. Based on a distance range defined in the Y direction correction table 72*b* including the calculated distance, and a Y-direction line width of the stroke input via the input device 6, a table value is determined and is set as a first color element level.

Note that a subpixel, the Y direction stroke-subpixel distance of which does not fall within any of the ranges defined in the Y direction correction table 72*b*, is not given the first color element level.

As described above, the first color element level of a subpixel is determined by the control section 3 based on the Y direction correction table 72*b*. When the line width of a character is "thick" in the Y direction correction table 72*b* of FIG. 6, the color element level is decreased in a stepwise manner such as 7, 5, 4, 2, 1 with an increase in the Y direction stroke-subpixel distance. When the line width of a character is "intermediate", the color element level is decreased in a stepwise manner such as 7, 4, 2, 1 with an increase in the Y direction stroke-subpixel distance. When the line width of a character is "thin", the color element level is decreased in a stepwise manner such as 7, 2, 1 with an increase in the Y direction stroke-subpixel distance. In the Y direction correction table 72*b* of FIG. 6, a distance between the centers of two subpixels adjacent in the Y direction to each other is defined to be 1 and the maximum value of the first color element level is defined to be 7.

Figure 7:
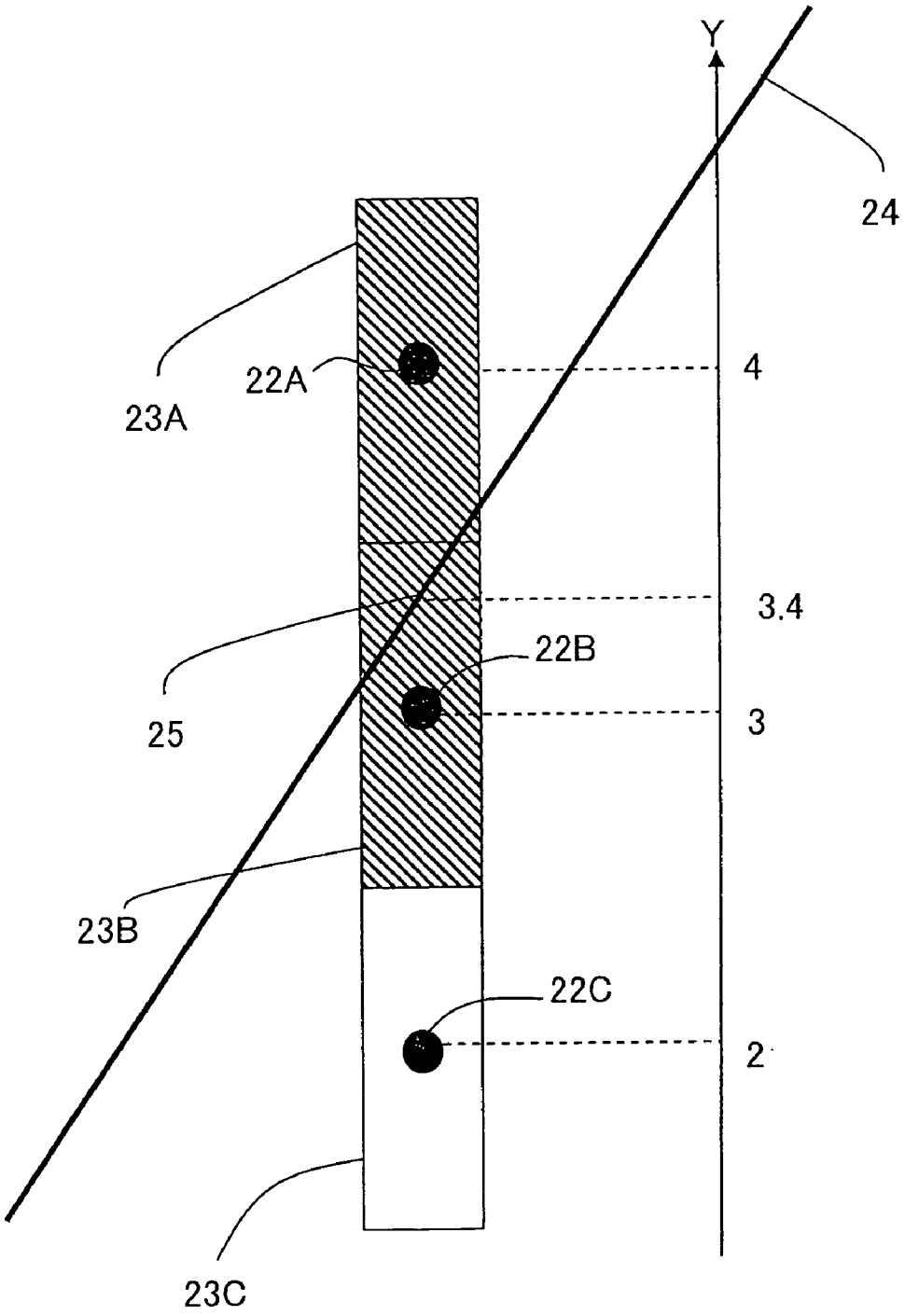
FIG. 7 is a diagram showing subpixels, through which a stroke made of a line segment is passed, and a subpixel near thereto.

FIG. 7 is a diagram showing a stroke, the skeleton data 71*b* (FIG. 1), of which is mapped onto the display screen 13 based on a character size, and some exemplary subpixels.

Hereinafter, a procedure of setting the first color element level of a subpixel of FIG. 7 using the control section 3 based on the Y direction correction table 72*b* will be described in detail.

In FIG. 7, three rectangles extending in a vertical direction represent a subpixel 23A, a subpixel 23B and a subpixel 23C, which are successively arranged in the Y direction. Filled circles 22A to 22C in the respective rectangles indicate center dots of the respective subpixels. A slanted straight line indicates a stroke 24.

The stroke 24 is passed through both the hatched subpixels 23A and 23B, each of which thus constitutes the basic portion of a character.

The Y-coordinate values of the center dots 22A to 22C of the subpixels 23A to 23C are 4, 3 and 2, respectively. The Y-coordinate value of a dot 25 on the stroke 24, which has the same X-coordinate value as that of the center dots 22A to 22C, is 3.4. Therefore, a Y direction stroke-subpixel distance calculated by the control section 3 is 1.4 for the subpixel 23C, 0.4 for the subpixel 23B, and 0.6 for the subpixel 23A.

Based on these results, the control-section 3 selects a range of 1.2 to 1.6 for the subpixel 23C from the Y direction stroke-subpixel distance ranges defined in the Y direction correction table 72*b*. The control section 3 also selects a range of 0.3 to 0.8 for the subpixel 23B from the Y direction stroke-subpixel distance ranges defined in the Y direction correction table 72*b*. The control section 3 also selects a range of 0.3 to 0.8 for the subpixel 23A from the Y direction stroke-subpixel distance ranges defined in the Y direction correction table 72*b*.

When the Y-direction line width of the stroke is set to "thick", the first color element level of the subpixel 23C is set to "2" which is the value of a portion at which a row containing the line width "thick" intersects a column containing the Y direction stroke-subpixel distance range of 1.2 to 1.6 in the Y direction correction table 72*b*. Also, the first color element level of the subpixel 23B is set to "5", which is the value of a portion at which the row containing the line width "thick" intersects a column containing the Y direction stroke-subpixel distance range of 0.3 to 0.8 in the Y direction correction table 72*b*. Also, the first color element level of the subpixel 23A is set to "5", which is the value of a portion at which the row containing the line width "thick" intersects the column containing the Y direction stroke-subpixel distance range of 0.3 to 0.8 in the Y direction correction table 72*b*.

When the Y-direction line width of the stroke is set to "intermediate", the first color element level of the subpixel 23C is set to "1", which is the value of a portion at which a row containing the line width "intermediate" intersects the column containing the Y direction stroke-subpixel distance range of 1.2 to 1.6 in the Y direction correction table 72*b*. Also, the first color element level of the subpixel 23B is set to "4", which is the value of a portion at which the row containing the line width "intermediate" intersects the column containing the Y direction stroke-subpixel distance range of 0.3 to 0.8 in the Y direction correction table 72*b*. Also, the first color element level of the subpixel 23A is set to "4", which is the value of a portion at which the row containing the line width "intermediate" intersects the column containing the Y direction stroke-subpixel distance range of 0.3 to 0.8 in the Y direction correction table 72*b*.

When the Y-direction line width of the stroke is set to "thin", the first color element level of the subpixel 23C is not set. This is because there is no value of a portion at which a row containing the line width "thin" intersects the column containing the Y direction stroke-subpixel distance range of 1.2 to 1.6 in the Y direction correction table 72*b*. Also, the first color element level of the subpixel 23B is set to "2", which is the value of a portion at which the row containing the line width "thin" intersects the column containing the Y direction stroke-subpixel distance range of 0.3 to 0.8 in the Y direction correction table 72*b*. Also, the first color element level of the subpixel 23A is set to "2" which is the value of a portion at which the row containing the line width "thin" intersects the column containing the Y direction stroke-subpixel distance range of 0.3 to 0.8 in the Y direction correction table 72*b*.

For subpixels having a Y direction stroke-subpixel distance of 2.0 or more, no first color element level is set. This is because such a distance is outside the Y direction stroke-subpixel distance range in the Y direction correction table 72*b*.

Even for a subpixel included in the basic portion of a character, such as the subpixel 23A or the subpixel 23B, when the Y direction stroke-subpixel distance is 0.3 or more, the first color element level is not set to the maximum value 7. In contrast, when the Y direction stroke-subpixel distance is less than 0.3, the first color element level is set invariably to the maximum value 7. As a result, when a stroke is passed through substantially the center of a subpixel, the first color element level is set invariably to the maximum value, so that a core portion of the stroke is emphasized. Thereby, the display quality can be improved. In this case, the color element level may not be necessarily the maximum value and may be close to the maximum value. In Embodiment 1, the maximum value is assumed to be "7".

Even for a subpixel which is not included in the basic portion of a character, such as the subpixel 23C, the first color element level is set depending on the Y direction stroke-subpixel distance and the Y-direction line width of a stroke.

In Embodiment 1, the first color element level of a subpixel is set using the Y direction correction table 72*b*, or alternatively, may be calculated directly from the above-described Y direction stroke-subpixel distance. For example, the first color element level of a subpixel can be obtained using a first-order function with the Y direction stroke-subpixel distance as a parameter. In this case, when the Y direction stroke-subpixel distance of a subpixel is within a range of a predetermined Y direction stroke-subpixel distance or more, the first color element level of the subpixel may not be set.

Next, the X direction correction table 73*b* will be described.

The X direction correction table 73*b* stored in the auxiliary storage apparatus 7 is used to set second color element levels for a subpixel having a first color element level set by the control section 3, and a subpixel(s) successively arranged in the X direction to the subpixel having the first color element level (i.e., a subpixel(s) having the same Y-coordinate value as that of the subpixel having the first color element). The X direction correction table 73*b* associates the value of a second color element level with a combination of the value of a set first color element level, a distance between a subpixel having the set first color element level and a subpixel of interest, and the X-direction line width of a stroke input via the input device 6.

FIG. 8 is a diagram showing exemplary numerical figures of the X direction correction table 73*b* stored in the auxiliary storage apparatus 7 of FIG. 1.

In the control section 3, when the X-direction line width of a stroke is set to be "thick", a second color element level is set using an X direction correction table 73*b* shown in FIG. 8(*a*). When the X-direction line width of a stroke is set to be "intermediate", a second color element level is set using an X direction correction table 73*b* shown in FIG. 8(*b*). When the X-direction line width of a stroke is set to be "thin", a second color element level is set using an X direction correction table 73*b* shown in FIG. 8(*c*).

For a subpixel placed within a predetermined range in the Y direction including the basic portion of a character, a first color element level is set using the above-described Y direction correction table 72*b*. For a subpixel within a predetermined range in the X direction including the above-described subpixel, a second color element level is set using the X direction correction table 73*b*.

In the X direction correction table 73*b* of FIG. 8, a distance from a subpixel, the first color element level of which has been set, is represented where a length in the X direction of each subpixel is 1.

When a line width in the X direction is "thick", the control section 3 sets a second color element level based on the X direction correction table 73*b* of FIG. 8(*a*) as follows.

For a subpixel, the first color element level of which has been set to "7", the second color element level is set to "7". For a subpixel, which is located a distance of one subpixel in the X direction from the subpixel having the first color element level "7", the second color element level is set to "5". For a subpixel, which is located a distance of two subpixels in the X direction from the subpixel having the first color element level "7", the second color element level is set to "4". For a subpixel, which is located a distance of three subpixels in the X direction from the subpixel having the first color element level "7", the second color element level is set to "3". For a subpixel, which is located a distance of four subpixels in the X direction from the subpixel having the first color element level "7", the second color element level is set to "2".

Similarly, for a subpixel, the first color element level of which has been set to "5", the second color element level is set to "5". For a subpixel, which is located a distance of one subpixel in the X direction from the subpixel having the first color element level "5", the second color element level is set to "4". For a subpixel, which is located a distance of two subpixels in the X direction from the subpixel having the first color element level "5", the second color element level is set to "3". For a subpixel, which is located a distance of three subpixels in the X direction from the subpixel having the first color element level "5", the second color element level is set to "1".

Similarly, for a subpixel, the first color element level of which has been set to "4", the second color element level is set to "4". For a subpixel, which is located a distance of one subpixel in the X direction from the subpixel having the first color element level "4", the second color element level is set to "2".

Similarly, for a subpixel, the first color element level of which has been set to "2", the second color element level is set to "2".

Similarly, for a subpixel, the first color element level of which has been set to "1", the second color element level is set to "1".

When a line width in the X direction is set to "intermediate" and "thin", a second color element level is set based on the X direction correction tables 73*b* of FIGS. 8(*b*) and 8(*c*), respectively.

In Embodiment 1, if different second color element levels are provided for a subpixel, the highest value among them is set as a final second color element level value. Alternatively, other statistical amounts, such as an average value, may be used.

Figure 9:
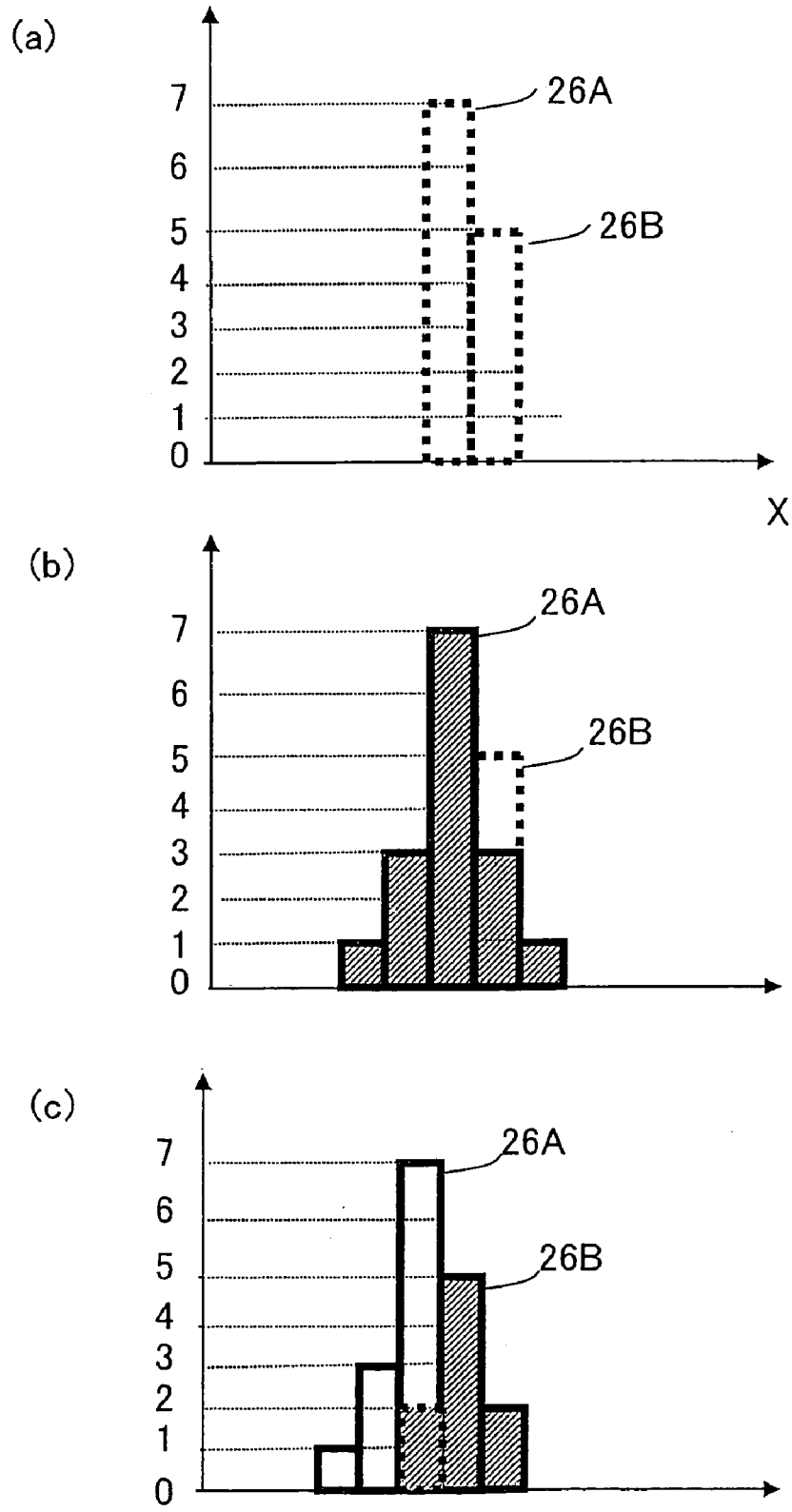
FIGS. 9(*a*) to 9(*c*) are diagrams for explaining a method for setting a second color element level from a first color element level.

FIG. 9(*a*) is a diagram showing two exemplary subpixels given respective first color element levels. In FIG. 9, the horizontal axis represents the X direction of a subpixel, while the vertical axis represents a first color element level and a second color element level set for each subpixel. In FIG. 9(*a*), the height of a vertical bar indicated by a dashed line indicates the degree of a first color element level. As shown in FIG. 9(*a*), the first color element level of a subpixel 26A is set to "7", while the first color element level of a subpixel 26B is set to "5".

Hereinafter, how the second color element level of each subpixel of FIG. 9(*a*) is set by the control section 3 will be described in detail, where it is assumed that a line width in the X direction is set to "thin".

FIG. 9(*b*) is a diagram showing a state after setting second color element levels for the subpixel 26A and subpixels successively arranged in the X direction from the subpixel 26A based on the first color element level of the subpixel 26A. In FIG. 9(*b*), the height of a vertical bar indicated by a thick line represents the degree of a second color element level.

The control section 3 references the X direction correction table 73*b* of FIG. 8(*c*) corresponding to when a line width in the X direction is "thin", to obtain a second color element level corresponding to "7", which is a first color element level set for the subpixel 26A.

According to the X direction correction table 73*b* of FIG. 8(*c*), second color element levels corresponding to the first color element level "7" are set to "7", "3", "1" in order of a distance from a subpixel having the set first color element level, the closest first. In FIG. 9(*b*), these values are represented by hatched portions. Therefore, as indicated by thick lines in FIG. 9(*b*), the second color element level of the subpixel 26A is set to "7", the second color element level of a subpixel located at a distance of one subpixel away in the X direction is set to "3", and the second color element level of a subpixel located at a distance of two subpixels away in the X direction is set to "1".

FIG. 9(*c*) is a diagram showing a state after setting second color element levels for the subpixel 26B and subpixels successively arranged in the X direction from the subpixel 26B based on the first color element level of the subpixel 26B. In FIG. 9(*c*), the height of a vertical bar indicated by a thick line represents the degree of a second color element level.

The control section 3 references the X direction correction table 73*b* of FIG. 8(*c*) corresponding to when a line width in the X direction is "thin", to obtain a second color element level corresponding to "5", which is a first color element level set for the subpixel 26B.

According to the X direction correction table 73*b* of FIG. 8(*c*), second color element levels corresponding to the first color element level "5" are set to "5", "2" in order of a distance from a subpixel having the set first color element level, the closest first. In FIG. 9(*c*), these values are represented by hatched portions. Therefore, as indicated by thick lines in FIG. 9(*c*), the second color element level of the subpixel 26B is set to "5", and the second color element level of a subpixel located at a distance of one subpixel away in the right-hand direction is set to "2". Note that the second color element level of a subpixel located at a distance of one subpixel in the left-hand direction away from the subpixel 26B is set to a higher value "7", so that the second color element level is not updated.

Next, the character display program 7*a* will be described.

Figure 10:
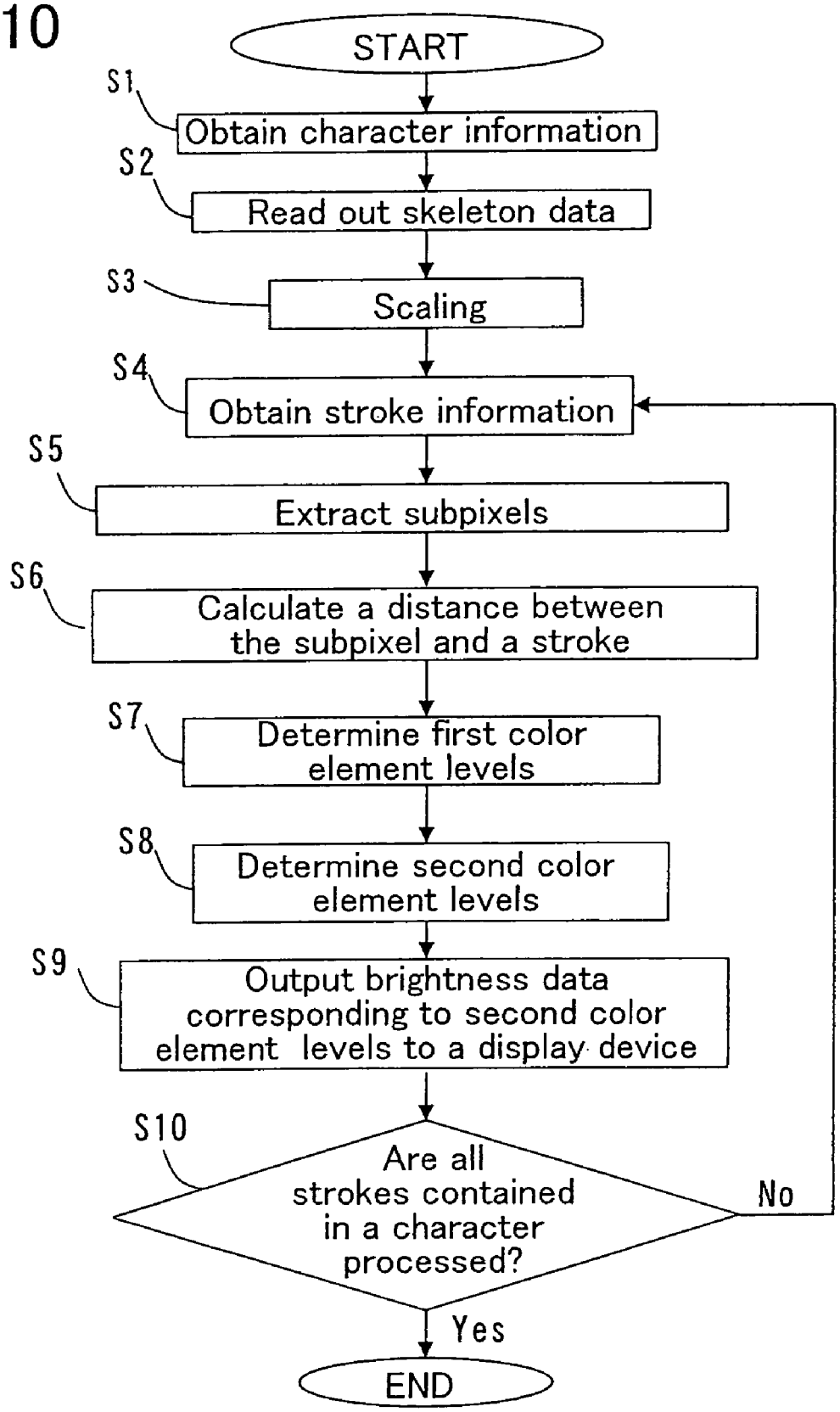
FIG. 10 is a flowchart showing a procedure of a character display method according to Embodiment 1 of the present invention.

FIG. 10 is a flowchart showing a procedure of the character display program 7*a* of FIG. 1. The character display program 7*a* is executed by the CPU 4. Hereinafter, each step included in the procedure of the character display program 7*a* will be described with reference to the flow of the procedure.

As shown in FIG. 10, in step S1, character information containing a character code, a character size, a sharpness of a stroke of a character to be displayed, and line widths in the X and Y directions of a stroke, is input via the input device 6. For example, a character code 4458 (JIS (Japanese Industrial Standards) kuten (character) code, ku (section) 44, ten (point) 58) is input in order to display a Kanji character "本" on the display device 2. A character size is represented by the number of dots in the horizontal direction of a character to be displayed and the number of dots in the vertical direction (e.g., 20 dots×20 dots). The sharpness of a stroke of a character to be displayed is indicated by a code corresponding to one of "sharp", "normal" and "soft", for example. The line widths in the X and Y directions of a stroke are indicated by codes each corresponding to one of "thick", "intermediate" and "thin", for example. Based on this code, the Y direction correction table 72*b* is determined.

Next, in step S2, the skeleton data 71*b* of a character corresponding to the input character code is stored into the main memory 5.

In step S3, the coordinate data 21 of the skeleton data 71*b* is scaled in accordance with the input character size. By scaling, a coordinate system preset for the coordinate data 21 of the skeleton data 71*b* is converted into an actual pixel coordinate system for the display device 2. Note that scaling is performed, taking the arrangement of subpixels into account.

In Embodiment 1, as shown in FIG. 2, a pixel 14 has three subpixels 15*a*, 15*b* and 15*c* arranged in the X direction. When a character size is 20 dots×20 dots, the coordinate data 21 of the skeleton data 71*b* is scaled to 60 (=20×3) subpixels×20 pixels.

In step S4, the data of a stroke (stroke information 18) is obtained from the skeleton data 71*b*.

In step S5, the line type 20 contained in the stroke information 18 is referenced. When the line type 20 is a straight line, subpixels, through which a straight line connecting the scaled coordinate data 21 is passed, and subpixels arranged in the Y direction near those subpixels, are extracted. When the line type 20 is a curve, subpixels, through which a curve approximating the scaled coordinate data 21 is passed, and near subpixels located above and below those subpixels, are extracted. The curve may be, for example, a spline curve.

In step S6, a distance between a dot on a stroke having the same X-coordinate value as that of a center dot of each subpixel and the center dot of the subpixel is calculated. For example, the distance can be calculated by the absolute value of a difference between the Y-coordinate values of the two dots.

In step S7, a first color element level is set based on the distance calculated in step S6 and the Y-direction line width of the stroke obtained in the step S1, with reference to the Y direction correction table 72*b*.

In step S8, for a subpixel(s) extracted in step S5, which is located in the X direction near each subpixel, a second color element level is set based on the first color element level set in step S7 and the X-direction line width of the stroke obtained in step S1, with reference to the X direction correction table 73*b*. Note that when a higher second color element level is already set, no update is performed.

In step S9, brightness data corresponding to the second color element level of the subpixel set in step S8 is transferred to the display device 2. The second color element level may be converted to brightness data with reference to table data.

In step S10, it is determined whether steps S4 to S9 are completed for all strokes contained in a character. If the result of the determination is negative ("No"), the procedure returns to the process in step S4. If the result of the determination is positive ("Yes"), the procedure is completed.

FIGS. 11A to 11D show how the color element levels of subpixels are set.

Figure 11A:
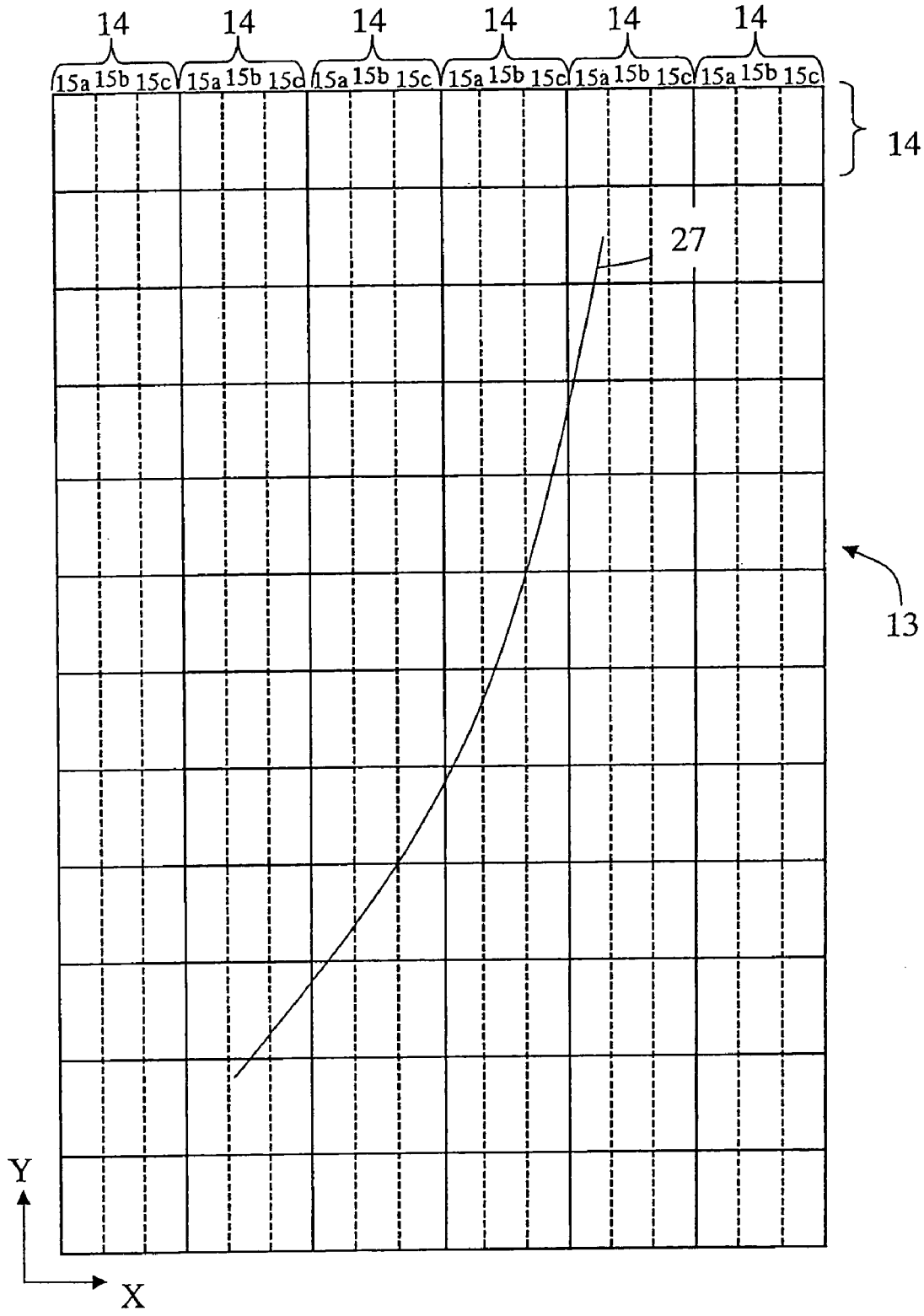
FIG. 11A is a diagram showing how color element levels are set in the character display method of Embodiment 1 of the present invention, indicating a stroke mapped onto a display screen.

FIG. 11A is a diagram showing a state of a stroke 27 after the coordinate data 21 thereof is scaled and is then mapped onto actual pixel coordinates of the display screen 13.

Figure 11B:
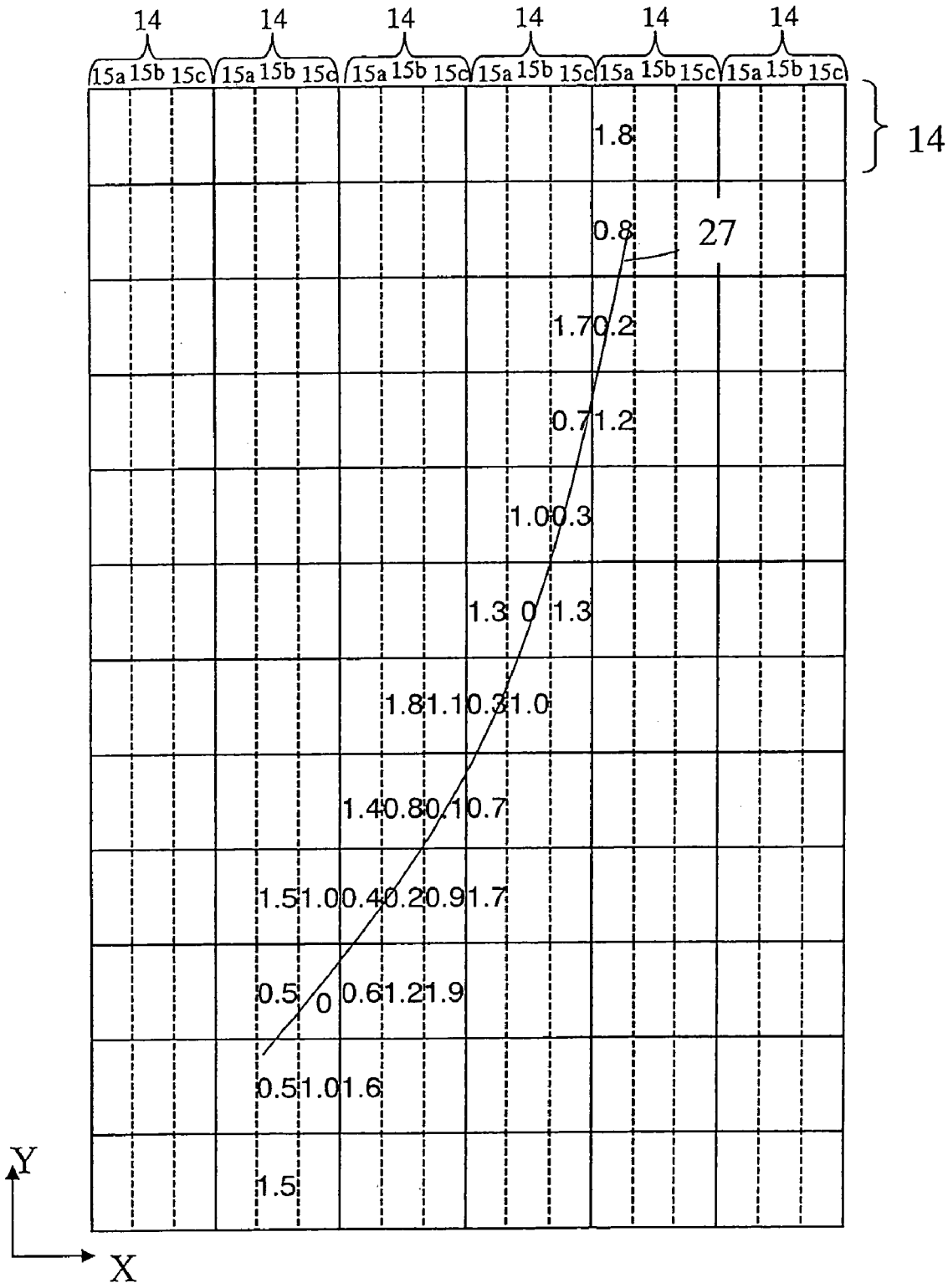
FIG. 11B is a diagram showing how color element levels are set in the character display method of Embodiment 1 of the present invention, indicating the result of calculation of a distance between a stroke and each subpixel of FIG. 11A.

FIG. 11B is a diagram showing the Y direction stroke-subpixel distance of each subpixel obtained by the control section 3, which is indicated in a rectangle corresponding to the subpixel. Note that subpixels having a Y direction stroke-subpixel distance of 2.0 or more have empty rectangles, because setting is not performed for the subpixels.

Figure 11C:
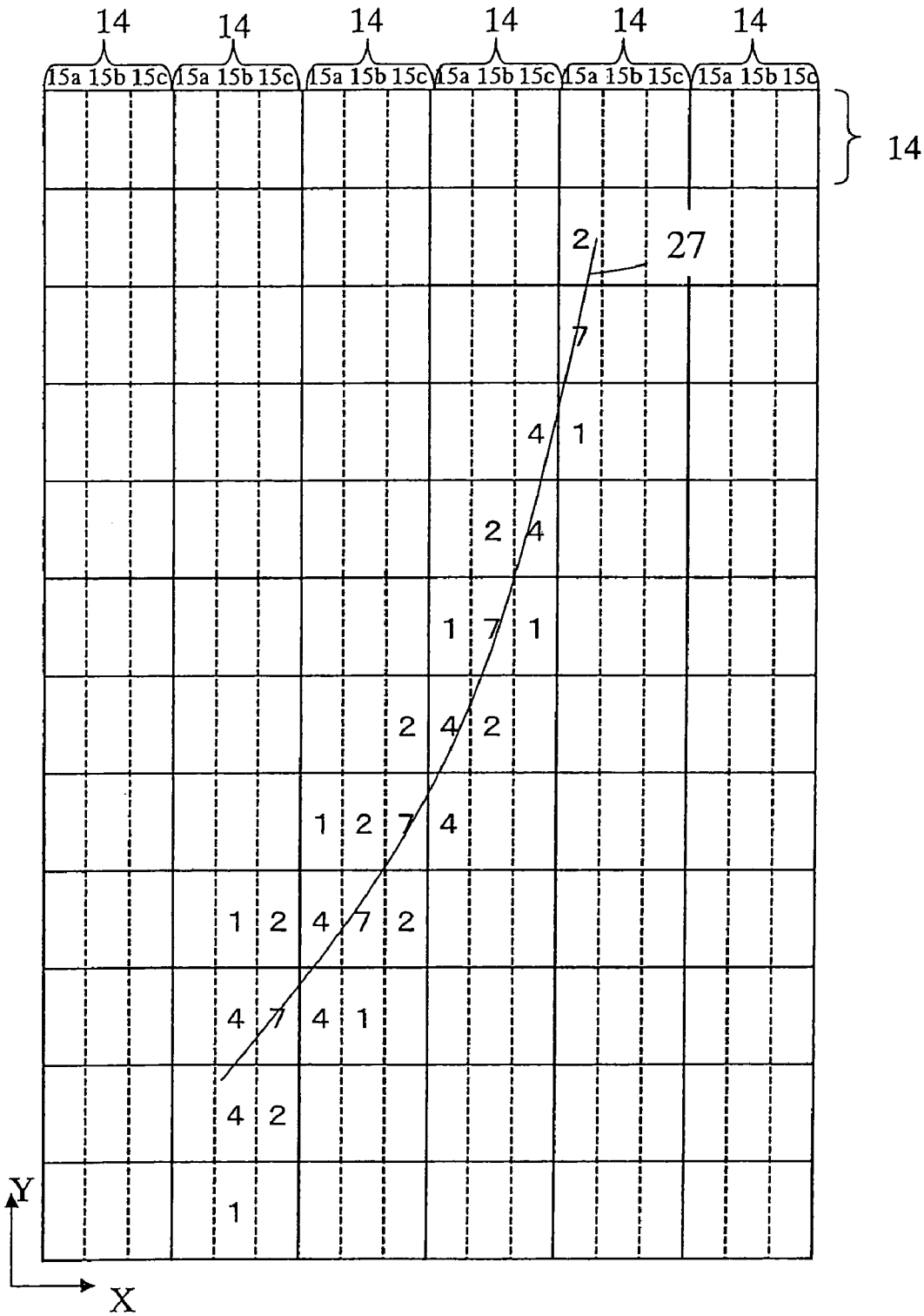
FIG. 11C is a diagram showing how color element levels are set in the character display method of Embodiment 1 of the present invention, indicating, first color element levels set based on the distances of FIG. 11B.

FIG. 11C is a diagram showing the first color element level of each subpixel of FIG. 11B set by the control section 3 based on the Y direction stroke-subpixel distance thereof, which is indicated in a rectangle corresponding to the subpixel. Note that the Y-direction line width of a stroke is set in data.

Figure 11D:
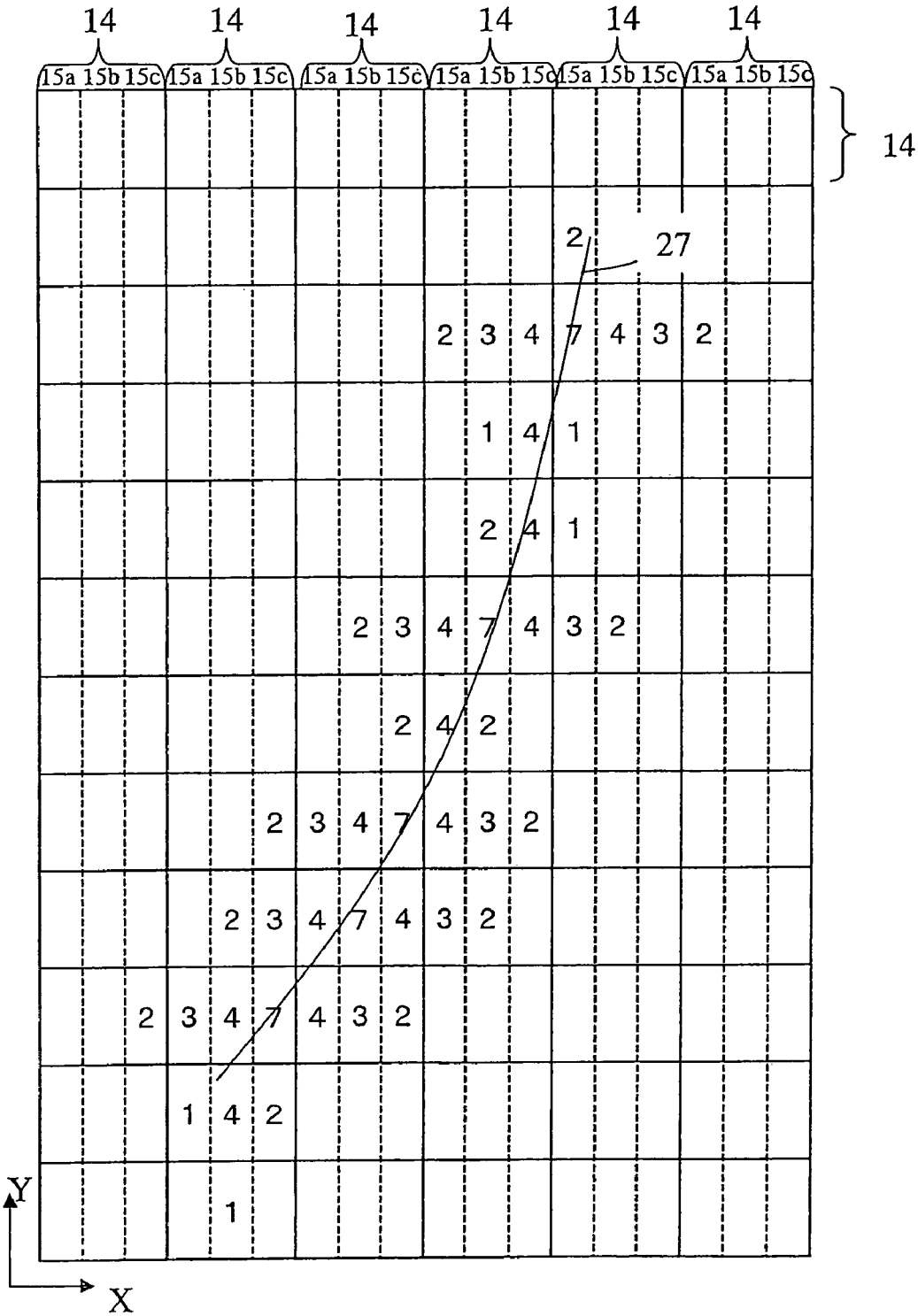
FIG. 11D is a diagram showing how color element levels are set in the character display method of Embodiment 1 of the present invention, indicating the results of second color element levels set based on the first color element levels of FIG. 11C.

FIG. 11D is a diagram showing the second color element level of each subpixel of FIG. 11C by the control section 3 based on the first color element level thereof, which is shown in a rectangle corresponding to the subpixel. Note that the X-direction line width of a stroke is set in data.

Embodiment 2

Figure 12:
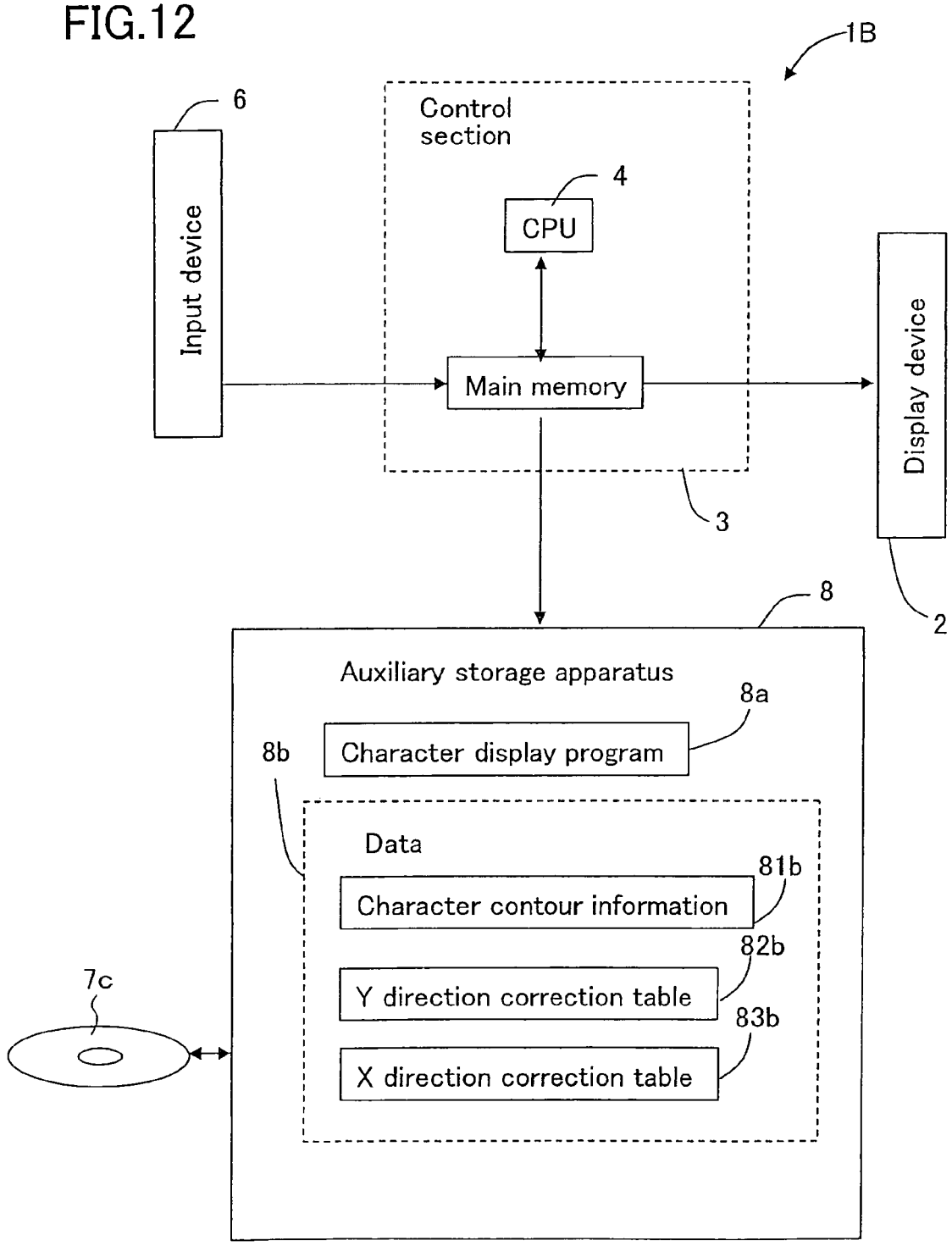
FIG. 12 is a block diagram showing a major configuration of a character display apparatus according to Embodiment 2 of the present invention.

FIG. 12 is a block diagram showing a major configuration of a character display apparatus according to Embodiment 2 of the present invention. In FIG. 12, the same parts as those of the character display apparatus 1A of Embodiment 1 of FIG. 1 are indicated by the same reference numerals and will not be explained.

In FIG. 12, the character display apparatus 1B comprises an auxiliary storage apparatus 8 which stores a character display program 8*a* and data 8*b* required for executing the character display program 8*a*. The data 8*b* contains character contour information 81*b* which defines a contour of a character, a Y direction correction table 82*b* and an X direction correction table 83*b*. Other parts are similar to those of the character display apparatus 1A of the above-described Embodiment 1. As the auxiliary storage apparatus 8, a storage apparatus of any type which can store the character display program 8*a* and the data 8*b* can be used. The character display program 8*a* and the data 8*b* may also be stored in the recording medium 7*c*.

Hereinafter, the data 8*b* stored in the auxiliary storage apparatus 8 will be described.

Firstly, the character contour information 81*b* will be described.

Figure 13:
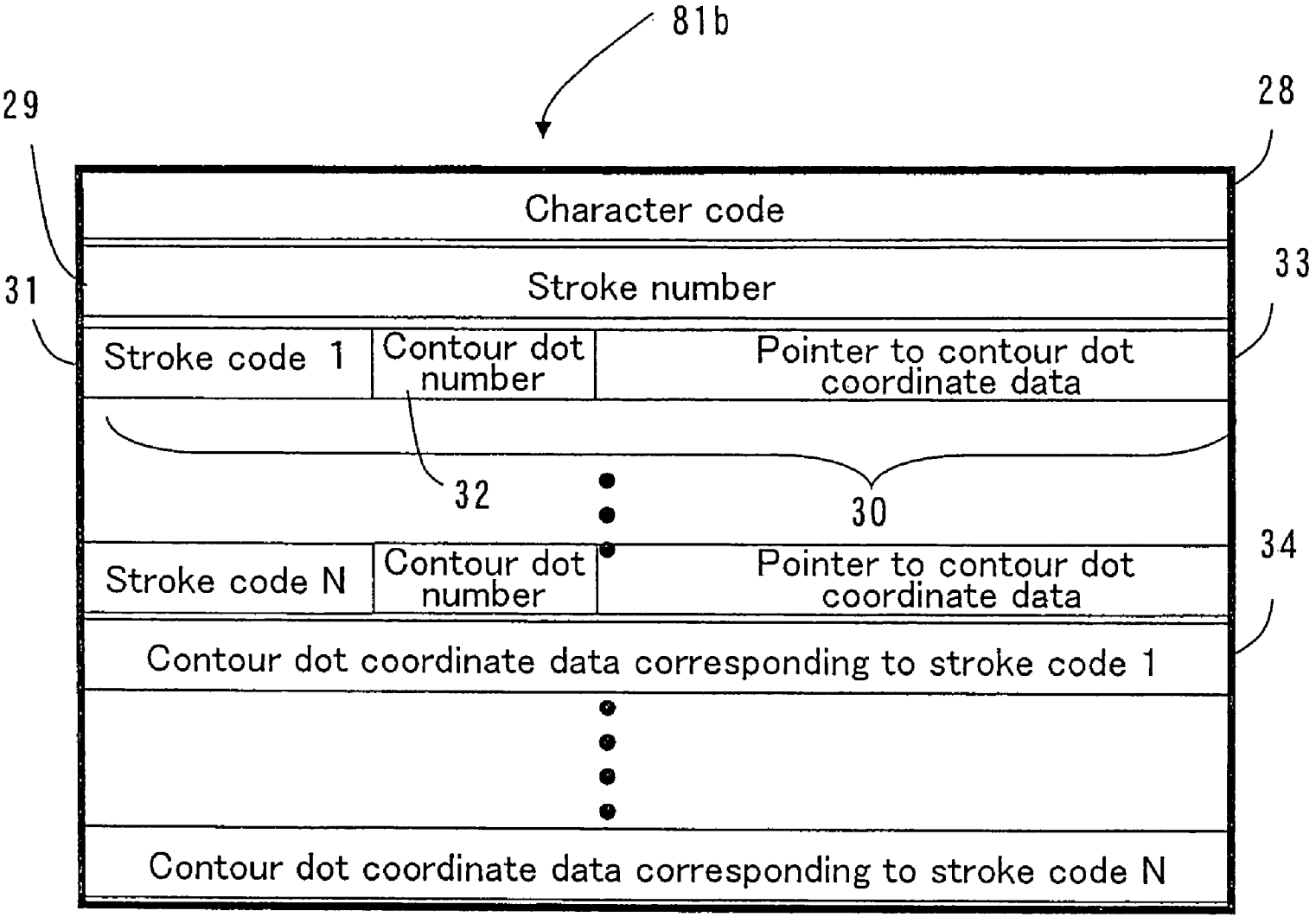
FIG. 13 is a diagram showing a data structure of character contour information of FIG. 12.

FIG. 13 is a diagram showing a data structure of the character contour information 81*b* stored in the auxiliary storage apparatus 8 in FIG. 12.

In FIG. 13, the character contour information 81*b* contains a character code 28 for distinguishing character types from one another, a stroke number 29 indicating the number of strokes constituting a character, and stroke information 30 corresponding to each stroke.

The stroke information 30 contains a stroke code 31 for distinguishing stroke types from one another, a contour dot number 32 indicating the number of contour dots constituting a stroke, and a pointer 33 to contour dot coordinate data 34 indicating coordinates of contour dots constituting a stroke. The pointer 33 indicates a position of the contour dot coordinate data 34 stored in the auxiliary storage apparatus 8. By referencing the stroke information 30, the coordinates of contour dots constituting a stroke can be obtained. In the contour dot coordinate data 34, the coordinates of contour dots constituting a stroke are arranged in an anticlockwise manner.

The number of sets of stroke information 30 is equal to the stroke number 29. Therefore, when the stroke number 29 is N (N is an integer of 1 or more), the character contour information 81*b* contains N sets of stroke information 30 for stroke codes 1 to N.

Examples of a method for representing a contour shape of a character include: (1) a contour line of a character is approximated with straight line(s); (2) a contour line of a character is approximated with a combination of a straight line(s) and a circular arc(s); (3) a contour line of a character is approximated with a combination of a straight line(s) and a curve(s) (e.g., a spline curve, etc.); and the like. The character contour information 81*b* may contain a plurality of contour dots obtained by any one of the above-described methods (1) to (3) as the contour dot coordinate data 34. Considering character quality and data capacity, it is preferable that the character contour information 81*b* contains the contour dot coordinate data 34 obtained by the method (3).

The character contour information 81*b* is stroke data for specifying the contour shape of each stroke constituting a character. Alternatively, the stroke data may define the skeletal shape of a stroke as described in Embodiment 1. To distinguish it from this, the stroke data is referred to as character contour information in Embodiment 2.

Next, the Y direction correction table 82*b* will be described.

The Y direction correction table 82*b* is used by the control section 3 to set first color element levels for the basic portion of a character to be displayed, and a subpixel(s) successively arranged in the Y direction from the basic portion of the character. In Embodiment 2, when the character contour information 81*b* is mapped onto the display screen 13 based on a character size, a subpixel containing a portion of a region enclosed by the contour of each stroke is assumed to constitute the basic portion of a character. Note that the Y direction correction table 72*b* of FIG. 6 and the X direction correction table 73*b* of FIG. 8 may be used as examples of the Y direction correction table 82*b* and the X direction correction table 83*b*, respectively, which will not be explained.

The control section 3 sets first color element levels for the basic portion of a character as follows.

When the center of a subpixel overlapping the basic portion of a character is located outside a region surrounded by the contour of a stroke, a shortest distance (hereinafter referred to as a Y direction stroke-subpixel distance) among distances to a dot on the contour of the stroke, which have the same X-coordinate value as that of the center of the subpixel, is calculated. When the center of the subpixel is located inside the region surrounded by the contour of a stroke, the Y direction stroke-subpixel distance is defined to be "0". A table value of the Y direction correction table 82*b*, which is determined based on a distance range defined in the Y direction correction table 82*b* including the calculated stroke-subpixel distance, and the Y-direction line width of a stroke input via the input device 6, is set as a first color element level.

Similarly, the control section 3 sets a first color element level(s) for a subpixel(s) successively arranged in the Y direction from the basic portion of a character as follows.

The Y direction stroke-subpixel distance of a subpixel successively arranged in the Y direction from the basic portion of a character is calculated. A table value of the Y direction correction table 82*b*, which is determined based on a distance range defined in the Y direction correction table 82*b* including the calculated stroke-subpixel distance and the Y-direction line width of a stroke input via the input device 6, is set as a first color element level.

Hereinafter, a procedure of setting the Y direction stroke-subpixel distance of a subpixel using the control section 3 will be described with reference to FIG. 14.

Figure 14:
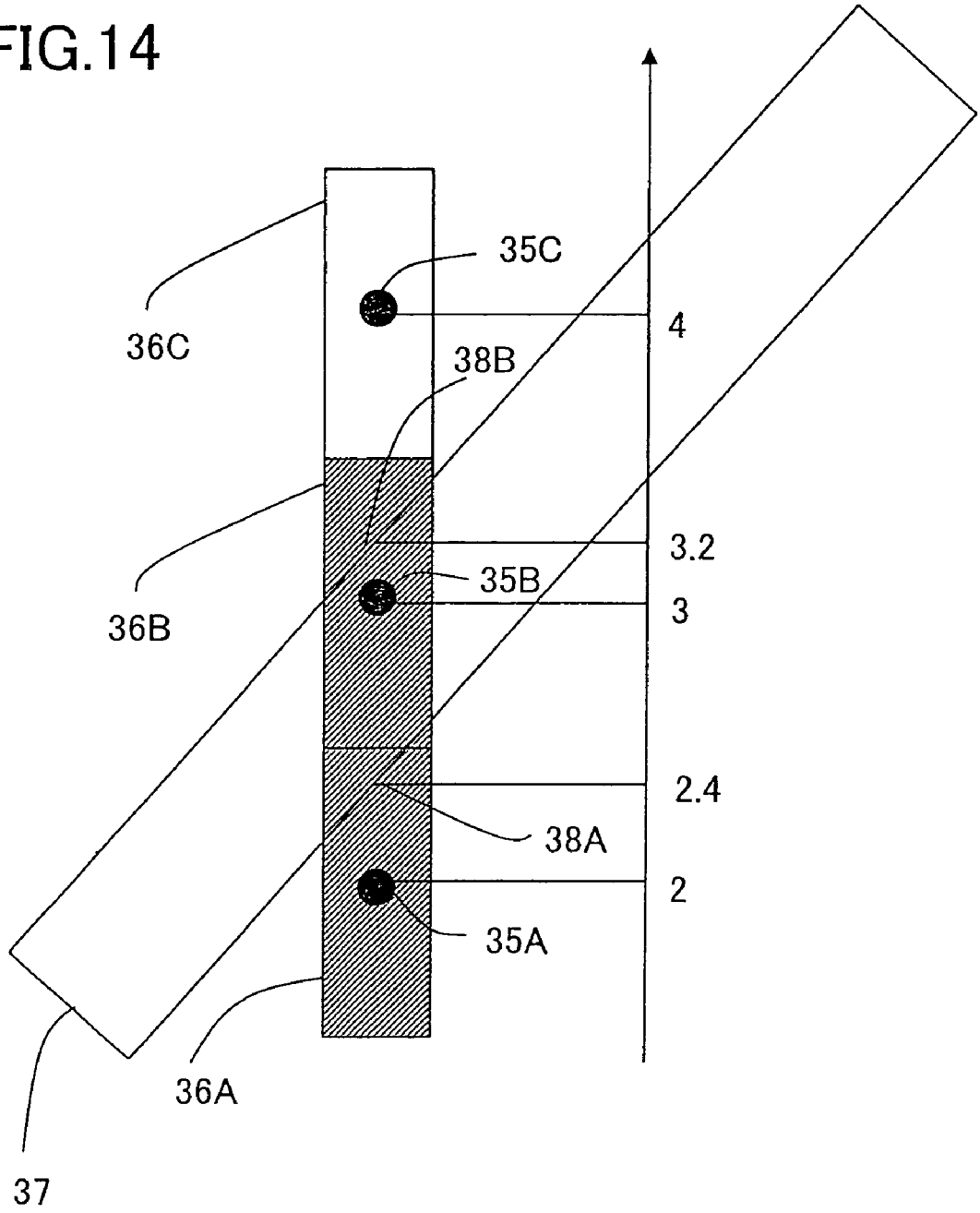
FIG. 14 is a diagram showing subpixels through which a stroke made of a contour line is passed, and a subpixel near thereto.

FIG. 14 is a diagram showing an exemplary stroke, which is obtained by mapping the character contour information 81*b* of FIG. 12 onto the display screen 13 based on a character size, and a portion of subpixels.

In FIG. 14, three rectangles represent, respectively, a subpixel 36A, a subpixel 36B and a subpixel 36C successively arranged in the Y direction. Filled circles 35A to 35C represent the center dots of the respective subpixels. A slanted rectangle represents a stroke 37.

The hatched subpixels 36A and 36B each overlap a portion of the stroke 37 and thus constitute the basic portion of a character.

The Y-coordinate values of the center dots 35A to 35C of the subpixels 36A, 36B and 36C are 2, 3 and 4, respectively. Dots 38A and 38B, which have the same X-coordinate value as that of the center dots 35A to 35C and are located on the contour of the stroke 37, have a Y-coordinate value of 2.4 and 3.2, respectively.

The center dot 35A of the subpixel 36A is located below the stroke 37, and therefore, is closer to the dot 38A than to the dot 38B. Therefore, the Y direction stroke-subpixel distance calculated by the control section 3 is a distance between the dot 38A and the center dot 35A of the subpixel 36A, which is 0.4.

The center dot 35B of the subpixel 36B is located within the range surrounded by the contour of the stroke 37. Therefore, the Y direction stroke-subpixel distance is 0.

The center dot 35C of the subpixel 36C is located above the stroke 37, and therefore, is closer to the dot 38B than to the dot 38A. Therefore, the Y direction stroke-subpixel distance calculated by the control section 3 is a distance between the dot 38B and the center dot 35C of the subpixel 36C, which is 0.8.

As described above, in Embodiment 2, the operation for calculating a Y direction stroke-subpixel distance using the control section 3 is different from that of Embodiment 1. Note that the operation for setting a first color element level based on a Y direction stroke-subpixel distance in accordance with the Y direction correction table 82*b*, and the operation for setting a second color element level based on the X direction correction table 83*b*, are similar to those described in Embodiment 1 and will not be explained below.

Next, the character display program 8*a* will be described.

Figure 15:
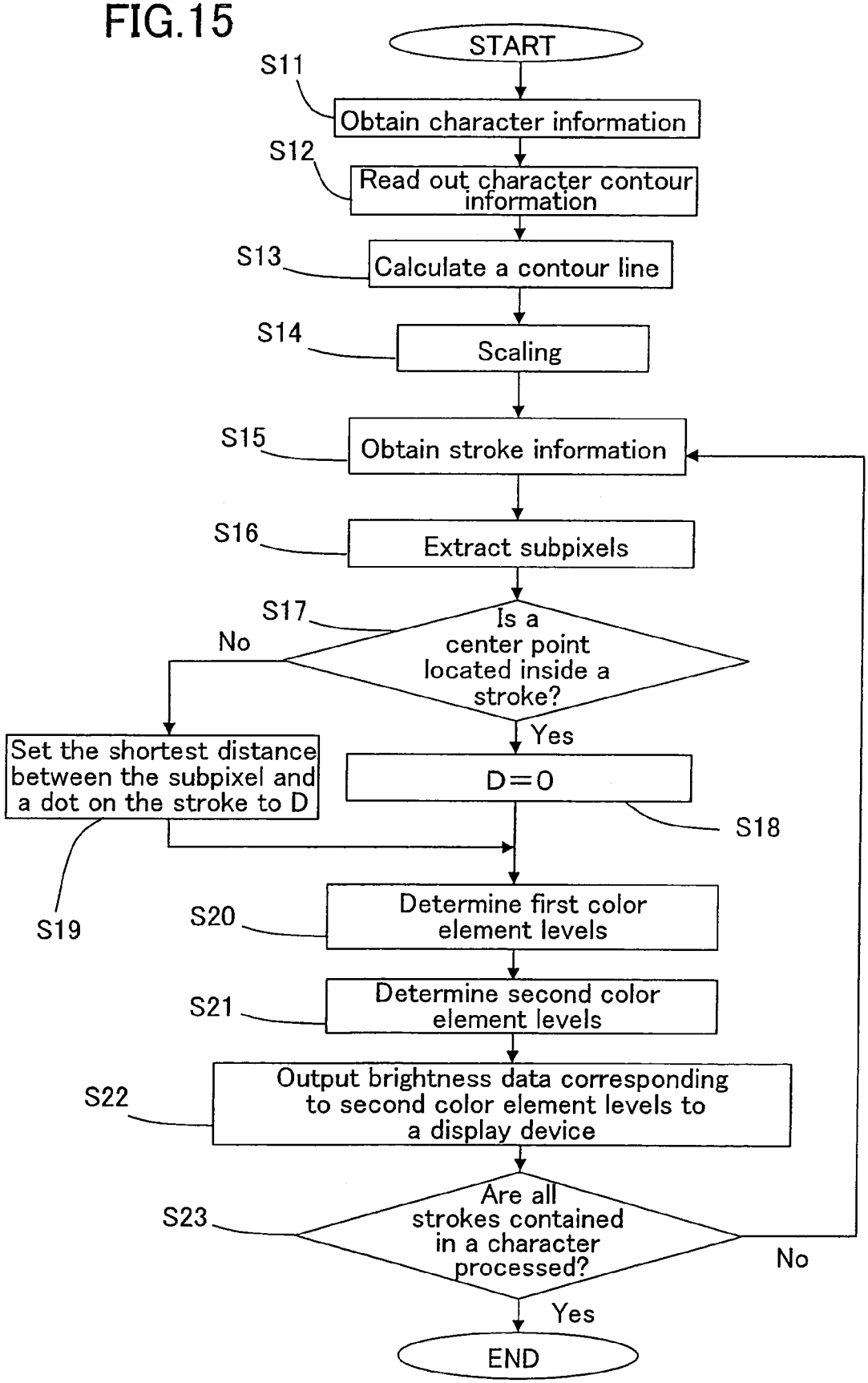
FIG. 15 is a flowchart showing a procedure of a character display method of Embodiment 2 of the present invention.
Figure 16:
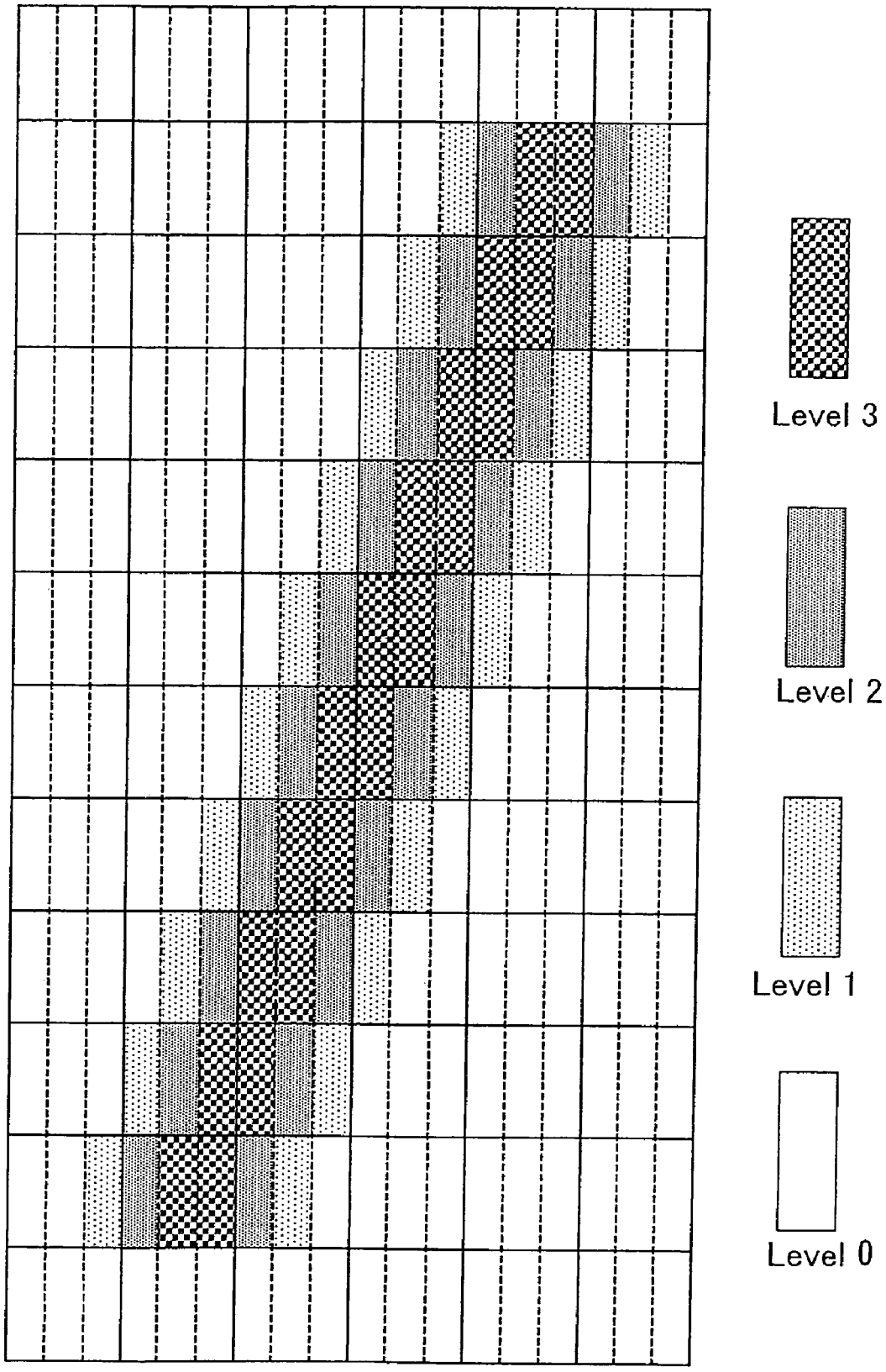
FIG. 16 is a diagram showing color element levels of subpixels on a slant line "/" displayed on a display screen using conventional technology.
Figure 17:
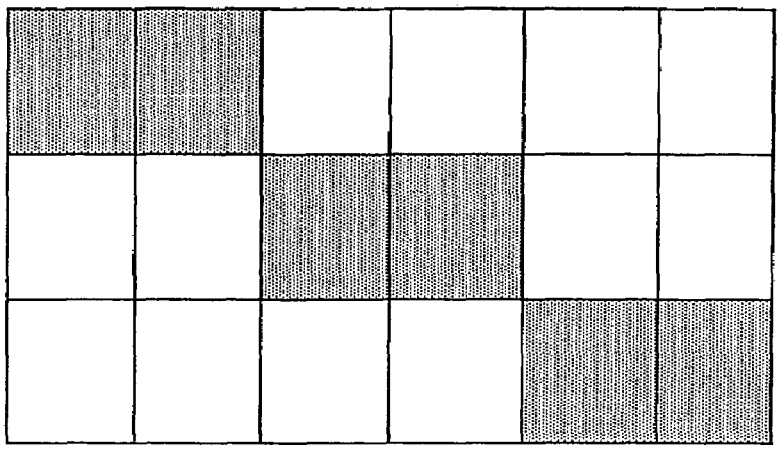
FIGS. 17(*a*) to 17(*c*) are diagrams for explaining an operation of a conventional display apparatus.
Figure 17:
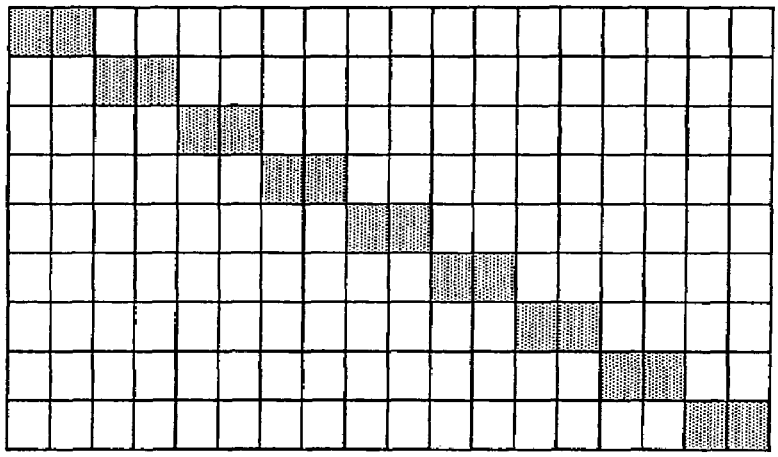
Figure 17:
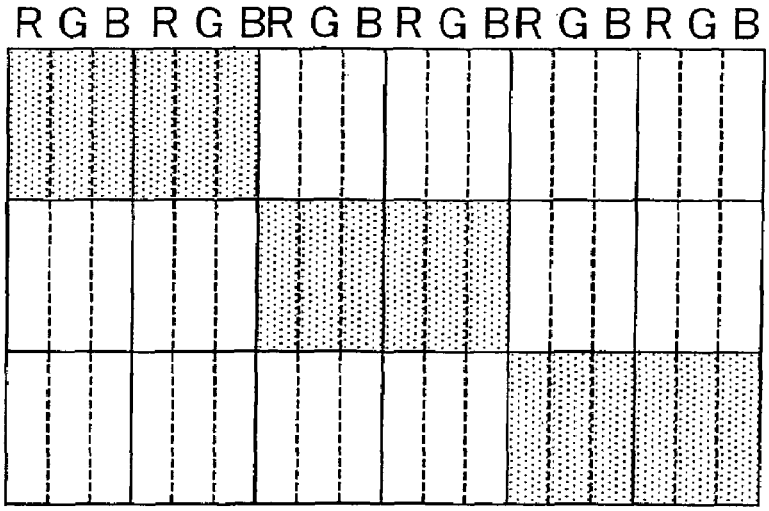

FIG. 15 is a flowchart showing a procedure of the character display program 8*a* of FIG. 12. The character display program 8*a* is executed by the CPU 4. Hereinafter, each step included in the procedure of the character display program 8*a* will be described with reference to the flow of the procedure.

As shown in FIG. 15, firstly, in step S11, character information containing a character code, a character size, a sharpness of a stroke of a character to be displayed, line widths in the X and Y directions of a stroke, is input via the input device 6. For example, a character code of 4458 (JIS (Japanese Industrial Standards) kuten (character) code, ku (section) 44, ten (point) 58) is input in order to display a Kanji character "木" on the display device 2. A character size is represented by the number of dots in the horizontal direction of a character to be displayed and the number of dots in the vertical direction (e.g., 20 dots×20 dots). The sharpness of a stroke of a character to be displayed is indicated by a code corresponding to one of "sharp", "normal" and "soft", for example. The line widths in the X and Y directions of a stroke are each indicated by a code corresponding to one of "thick", "intermediate" and "thin", for example. Based on this code, the Y direction correction table 82*b* is determined.

Next, in step S12, the character contour information 81*b* of a character corresponding to the input character code is read out into the main memory 5.

In step S13, an ideal contour line of a character is calculated based on the contour dot coordinate data 34 of a stroke based on the character contour information 81*b*. The ideal contour line of a character is approximated using a straight line(s) or a curve(s) in accordance with a known method.

In step S14, the ideal contour line of the character calculated in step S13 is scaled in accordance with the input character size. By scaling, a coordinate system preset for the contour dot coordinate data 34 is converted into an actual pixel coordinate system for the display device 2.

In step S15, data of a stroke is obtained from the scaled contour line of the character of step S14.

In step S16, a subpixel including a region surrounded by the contour of the stroke obtained in step S15 and a neighboring subpixel successively arranged in the Y direction are extracted.

In step S17, it is determined whether or not the center dot of each subpixel extracted in step S16 is located inside the stroke obtained in step S15. When the result of step S17 is "Yes", the procedure goes to step S18. When the result of step S17 is "No", the procedure goes to step S19.

In step S18, a distance D is set to "0". The procedure goes to step S20.

In step S19, the distance D is set to a distance between the center dot of each subpixel extracted in step S16 and one of the dots on the contour of a stroke which has the same X-coordinate value as and is closet to the center dot.

In step S20, a first color element level is set based on the distance D set in step S18 or step S19 and the Y-direction line width of a stroke obtained in step S11 with reference to the Y direction correction table 82*b*.

Next, in step S21, a second color element level is set for a subpixel(s) located in the X direction near each subpixel extracted in step S16, based on the first color element level set in step S20 and the X-direction line width of the stroke obtained in step S11, with reference to the X direction correction table 83*b*. Note that when a higher second color element level is already set, no update is performed.

In step S22, brightness data corresponding to the second color element level of the subpixel set in step S21 is transferred to the display device 2.

In step S23, it is determined whether steps S15 to S22 are completed for all strokes contained in a character. If the result of the determination is "No", the procedure returns to step S15. If the result of the determination is "Yes", the procedure is completed.

As described above, according to Embodiments 1 and 2, the control section 3 controls and sets the color element level of a subpixel based on a distance between the center of the subpixel and at least one dot contained in a stroke and a line width set for the stroke, so that a character can be displayed on a display screen of the display device 2. As a result, the resolution in the longitudinal direction of subpixels can be apparently improved and the line width of a character can be freely changed without a large amount of working memory.

Although not specified in Embodiment 1 or 2, the color element level of a subpixel can be controlled to be set based on at least one of a distance between the center of the subpixel and at least one dot contained in a stroke and a line width set for the stroke, so that a character can be displayed on a display screen of the display device 2. For example, the color element level of a subpixel may be controlled to be set based on a distance between the center of a subpixel and two dots contained in a stroke, or alternatively, may be controlled and reset only based on a line width.

INDUSTRIAL APPLICABILITY

According to the present invention, a plurality of color element levels corresponding to a plurality of subpixels are controlled based on a positional relationship between the subpixels and a stroke. Thereby, a character can be displayed quickly and with high definition without a large amount of working memory.

In addition, a plurality of color element levels corresponding to a plurality of subpixels are controlled based on the line width of a stroke. Thereby, a character can be displayed freely and with high definition while changing the width of the character.

The invention claimed is:

1. A character display apparatus for displaying a character on a screen based on stroke data containing character information, comprising:

a control section for referencing the stroke data to extract subpixels based on the stroke data and setting a first color element level for an extracted subpixel overlapping a basic portion of the character, based on both or either a first distance between a center of the extracted subpixel and at least one dot contained in a stroke in a first direction or a line width set for the stroke, and the control section setting a second color element level for a subpixel near the extracted subpixel having the set first color element level, based on a second distance between the extracted subpixel having the set first color element level and the near subpixel in a second direction perpendicular to the first direction and the set first color element level.

2. The character display apparatus according to claim 1, wherein the at least one dot contained in the stroke has the same X-coordinate value as the center of the subpixel.

3. The character display apparatus according to claim 1, wherein the control section sets a smaller first color element level of the subpixel as the first distance is increased.

4. The character display apparatus according to claim 1, wherein the control section sets the first color element level of the subpixel based on a line width in at least one of an X direction and a Y direction set for the stroke.

5. The character display apparatus according to claim 1, wherein the control section sets the first color element level of the subpixel to a predetermined value when the first distance is within a predetermined range.

6. The character display apparatus according to claim 1, comprising a display section comprising a plurality of display pixels arranged in a matrix on the screen, each of the plurality of display pixels comprising a plurality of the subpixels arranged in a predetermined direction and associated with a plurality of respective color elements, wherein the control section controls display of the character on the screen by controlling levels of the plurality of color elements associated with the plurality of subpixels based on the stroke data separately.

7. The character display apparatus according to claim 1, comprising a storage section storing a table associating at least one of the first distance between the center of the subpixel and the at least one dot contained in the stroke and the line width set for the stroke with the first color element level of the subpixel, wherein the control section sets the first color element level of the subpixel based on information contained in the table.

8. The character display apparatus according to claim 1, comprising a storage section storing a table associating the second distance between the subpixel having the set first color element level and the near subpixel and the set first color element level with the second color element level of the near subpixel, wherein the control section sets the second color element level of the near subpixel based on information contained in the table.

9. The character display apparatus according to claim 1, wherein the stroke data is skeleton data representing a skeletal shape of the character or character contour information representing a contour shape of the character.

10. A character display apparatus for displaying a character based on stroke data containing character information, comprising:

a control section for referencing the stroke data to extract subpixels based on the stroke data and setting a first color element level for an extracted subpixel within a predetermined range based on both or either a first distance between a center of the extracted subpixel and at least one dot contained in a stroke in a first direction or a line width set for the stroke, and the control section setting a second color element level for a subpixel near the extracted subpixel having the set first color element level, based on a second distance between the extracting subpixel having the set first color element level and the near subpixel in a second direction perpendicular to the first direction and the set first color element level.

11. The character display apparatus according to claim 10, wherein the control section sets the first color element level of the subpixel within the predetermined range based on a predetermined table defining the first color element level of the subpixel within the predetermined range and the first distance.

12. The character display apparatus according to claim 10, wherein the at least one dot contained in the stroke has the same X-coordinate value as the center of the subpixel.

13. The character display apparatus according to claim 10, wherein the control section sets a smaller first color element level of the subpixel as the first distance is increased.

14. The character display apparatus according to claim 10, wherein the control section sets the first color element level of the subpixel based on a line width in at least one of an X direction and a Y direction set for the stroke.

15. The character display apparatus according to claim 10, wherein the control section sets the first color element level of the subpixel to a predetermined value when the first distance is within a predetermined range.

16. The character display apparatus according to claim 10, comprising a display section comprising a plurality of display pixels arranged in a matrix on the screen, each of the plurality of display pixels comprising a plurality of the subpixels arranged in a predetermined direction and associated with a plurality of respective color elements, wherein the control section controls display of the character on the screen by controlling levels of the plurality of color elements associated with the plurality of subpixels based on the stroke data separately.

17. The character display apparatus according to claim 10, comprising a storage section storing a table associating at least one of the first distance between the center of the subpixel and the at least one dot contained in the stroke and the line width set for the stroke with the first color element level of the subpixel, wherein the control section sets the first color element level of the subpixel based on information contained in the table.

18. The character display apparatus according to claim 10, comprising a storage section storing a table associating the second distance between the subpixel having the set first color element level and the near subpixel and the set first color element level with the second color element level of the near subpixel, wherein the control section sets the second color element level of the near subpixel based on information contained in the table.

19. The character display apparatus according to claim 10, wherein the stroke data is skeleton data representing a skeletal shape of the character or character contour information representing a contour shape of the character.

20. A character display method for displaying a character based on stroke data containing character information, comprising:

referencing the stroke data to extract subpixels based on the stroke data, both or either the step of obtaining a first distance between a center of an extracted subpixel overlapping a basic portion of the character, and at least one dot contained in a stroke in a first direction, or the step of obtaining a line width set for the stroke, and the step of setting a first color element level for the extracted subpixel based on both or either the obtained first distance or the line width, further comprising the step of obtaining a second distance between a near subpixel and the extracted subpixel having the set first color element level in a second direction perpendicular to the first direction, and the step of setting a second color element level for the subpixel near the extracted subpixel having the set first color element level based on the obtained second distance and the set first color element level.

21. A computer readable recording medium having stored thereon computer executable program for displaying a character based on stroke data containing character information, comprising:

referencing the stroke data to extract subpixels based on the stroke data, both or either the step of obtaining a first distance between a center of an extracted subpixel overlapping a basic portion of the character and at least one dot contained in a stroke in a first direction, or the step of obtaining a line width set for the stroke, and the step of setting a first color element level for the extracted subpixel based on both or either the obtained distance or the line width, further comprising the step of obtaining a second distance between a near subpixel and the extracted subpixel having the set first color element level in a second direction perpendicular to the first direction, and the step of setting a second color element level for the subpixel near the extracted subpixel having the set first color element level based on the obtained second distance and the set first color element level.

22. A character display method for displaying a character on a screen based on stroke data containing character information, comprising:

referencing the stroke data to extract subpixels based on the stroke data, both or either the step of obtaining a first distance in a first direction between a center of an extracted subpixel within a predetermined range, and at least one dot contained in a stroke, or the step of obtaining a line width set for the stroke, and the step of setting a first color element level for the extracted subpixel based on both or either the obtained first distance or the line width, further comprising the step of obtaining a second distance in a second direction perpendicular to the first direction between a subpixel and the extracted subpixel having the first set color element level, and the step of setting a second color element level for the subpixel near the extracted subpixel having the set first color element level based on the obtained second distance and the set first color element level.

23. A computer readable recording medium having stored thereon computer executable program for displaying a character on a screen based on stroke data containing character information, comprising:

referencing the stroke data to extract subpixels based on the stroke data, both or either the step of obtaining a first distance between a center of an extracted subpixel within a predetermined range, and at least one dot contained in a stroke in a first direction, or the step of obtaining a line width set for the stroke, and the step of setting a color element level for the extracted subpixel based on both or either the obtained first distance or the line width, further comprising the step of obtaining a second distance between a subpixel and the extracted subpixel having the set first color element level in a second direction perpendicular to the first direction, and the step of setting a second color element level for the subpixel near the extracted subpixel having the set first color element level based on the obtained second distance and the set first color element level.

* * * * *